US008353167B2

(12) United States Patent
McGann

(10) Patent No.: US 8,353,167 B2
(45) Date of Patent: Jan. 15, 2013

(54) SOLAR-POWERED REFRIGERATED CONTAINER

(75) Inventor: Ryan McGann, Shoreham, NY (US)

(73) Assignee: Ignite Innovations LLC

( * ) Notice: Subject to any disclaimer, the term of this patent is extended or adjusted under 35 U.S.C. 154(b) by 733 days.

(21) Appl. No.: 12/148,126

(22) Filed: Apr. 16, 2008

(65) Prior Publication Data

US 2009/0277187 A1 Nov. 12, 2009

Related U.S. Application Data

(60) Provisional application No. 60/923,293, filed on Apr. 16, 2007.

(51) Int. Cl.
*F25B 21/02* (2006.01)

(52) U.S. Cl. ..... 62/3.62

(58) Field of Classification Search ..... 62/3.1–3.6, 62/3.61, 3.62, 235.1, 240, 259, 457.1, 3, 62/126, 156, 171, 179–180, 229, 408, 440, 62/429, 457.7, 457.9, 3.7, 362; 165/454; 286/365, 366, 367, 407, 410, 411, 424
See application file for complete search history.

(56) References Cited

U.S. PATENT DOCUMENTS 4,301,658 A * 11/1981 Reed ..... 62/3.3
4,328,676 A * 5/1982 Reed ..... 62/3.62
4,754,376 A * 6/1988 Winslow ..... 362/92
4,981,019 A * 1/1991 Hicks et al. ..... 62/3.62
5,379,596 A * 1/1995 Grayson ..... 62/3.62
5,483,799 A * 1/1996 Dalto ..... 62/3.7
5,501,076 A * 3/1996 Sharp et al. ..... 62/3.6
5,566,062 A * 10/1996 Quisenberry et al. ..... 363/89
6,021,642 A * 2/2000 Guinn ..... 62/3.6
6,305,185 B1 * 10/2001 Sloan ..... 62/457.7
2002/0104318 A1 * 8/2002 Jaafar et al. ..... 62/3.6
2004/0143297 A1 * 7/2004 Ramsey, III ..... 607/5
2006/0000221 A1 * 1/2006 Culp et al. ..... 62/3.6
2006/0032687 A1 * 2/2006 Park et al. ..... 180/206

* cited by examiner

*Primary Examiner* — Frantz Jules
*Assistant Examiner* — Emmanuel Duke
(74) *Attorney, Agent, or Firm* — Thomas A. O'Rourke; Bodner & O'Rourke, LLP

(57) ABSTRACT

A portable, solar assisted, temperature controlled container comprises: a body with a cavity; a lid sealable thereon; a detachable solar panel producing electric power; a thermoelectric cooling unit; an interior heat sink secured in the cavity proximate to an interior side of the thermoelectric cooling unit with an interior fan to direct cavity air thereon; an exterior heat sink secured proximate to an exterior-facing side of the thermoelectric cooling unit with an exterior fan to direct exterior air thereon. The thermoelectric cooling unit transports heat to maintain a thermostat-controlled temperature in the cavity. The interior and exterior fans and the interior and exterior heat sinks increase efficiency of the heat transport. One or more wheels rotatably attached to the body are coupled to a faraday generator to generate electrical power to replace/supplement the solar power. A rechargeable battery may also replace/supplement solar power during periods of inadequate solar power generation.

6 Claims, 35 Drawing Sheets

SOLAR-POWERED REFRIGERATED CONTAINER

The present invention claims priority on U.S. application Ser. No. 60/923,293 filed Apr. 16, 2007, the disclosures of which are incorporated herein by reference.

FIELD OF THE INVENTION

The present invention relates generally to an environmentally friendly refrigeration unit and more particularly solar-powered refrigeration container that allows stored foods, beverages and other objects to be properly refrigerated when outdoors and more specifically to a refrigeration container that employs for example, a system of heat sinks, fans and vents powered by a rechargeable internal battery that gathers fuel from a solar collector on the container's outer surface and maintains an insulated environment within the container that is up to about 40° below the ambient temperature.

BACKGROUND OF THE INVENTION

The portable cooler was invented in Australia, where it is known as an "esky," in the 1950s for keeping beer and other beverages cool even in warm climates. Today, a cooler is most commonly an insulated box, and it is used to keep food and drink cool. Coolers are often taken on picnics, to the beach, to tailgating events or on vacation. They are typically constructed of an interior and exterior layer of plastic, with a hard foam in between the two layers and come in all different sizes. Most coolers have a handle for easy carriage and some even have wheels, thus enabling transport without lifting the whole container. A typical shortcoming of these types of coolers, however, is the constant need to refill the box with ice or ice packs in order to keep the inside environment cool. When ice begins to melt, which will typically happen on a hot day within minutes, food and beverages are often saturated in the resultant water, making removal of the contained objects an unpleasant task.

Another use of portable coolers in recent years has developed with regard to organ donations and transplant. All organs only remain viable for a short period of time and for some organs, such as hearts, this time is about four hours. However, it has long been known that organs will survive ex vivo longer if they are kept at an extremely cool temperature. This is because, at that temperature, the metabolism is greatly reduced, lowering the requirements for nutrients and oxygen, and the production of lactic acid and other toxic end products of metabolism are also greatly reduced. Another possible medical use for coolers is to store and keep fresh certain medication. Some medication require medication, such as insulin, somatropin, and drugs that have been reconstituted. A person who is at the beach, or on a picnic may need to have that medication available for use during their trip. Furthermore, if there if a paramedic or other form of emergency personnel needs to transport that medication to a patient, a cooler can be used to keep the temperature low enough for the medication to be fresh. Therefore, it is well known in the art that coolers are serve medical purposes, such as to keep organs viable as they are transported for transplant and to keep medication refrigerated when necessary. In such a field, it would be necessary to be constantly replenishing ice or ice packs in order to keep the temperature at the desired level.

Thus, in the art, it is well known that some modern coolers are run, without ice or ice packs, by thermoelectric power, usually coming from a car's cigarette lighter socket. They typically operate through use of a fan and vent system and are able to maintain a temperature-controlled environment. One of the main problems of the prior art thermoelectric containers is that they do draw a significant amount of power however, and can drain a car's battery enough so that it cannot start. Most electric coolers have an undervoltage shutoff at around 10 or 10.5 to prevent this.

The present invention utilizes instead solar power to achieve refrigeration of the objects contained within its confines without necessity for ice and without needing to plug the container into a power source.

SUMMARY OF THE INVENTION

The present invention is directed to an environmentally friendly refrigeration unit. In one embodiment, the invention is directed to a solar-powered refrigerated container for the storage and chilling of food, beverages or any other applicable products. The container utilizes solar energy gathered from a solar collector on its outer surface to power a refrigeration system that is able to maintain a temperature that is 40° below the outside temperature. In another embodiment the refrigeration unit may be powered by a faraday generator or an electric generator powered by movement of the wheels of the device along a surface such as the ground. In a still further embodiment, the refrigeration unit may be powered by a wind turbine or other wind powered generation system. In a still further embodiment, the refrigeration unit may be powered by waves and/or human power.

In the preferred embodiment, the refrigerated container is characterized as generally a base and one or more sidewalls extending therefrom to form a box like receptacle. The receptacle is provided with one of more cavities for receiving the components of the device as well as the products to be kept refrigerated. The unit of the present invention may be of any suitable shape or size. The container has a body including a housing and an insulated interior container. The housing provides protection from the elements outside the container for the objects held within the container. The insulated interior container, on the other hand provides both insulation from the outside environment's temperature, but also provides a safe interior environment for liquid beverages and solid foods to be held without concern that any leakage to the outside will occur, causing an unwanted mess. The housing has both a top and bottom surface, as well as at least one sidewall. The top surface is generally open and the interior insulated container fits snugly within its confines. The interior container may be a separate member or may be a single unit. The interior container has an interior surface comprising at least one sidewall, an open upper surface and a closed bottom surface. In the preferred embodiment there is an orifice through both the housing and the insulated interior container through which a fan is preferably placed. Internal and external environments preferably never mix. Also, the bottom surface of the housing may contain wheels, preferably at least two for easy transport of the cooler from one place to another.

The container of the present invention also has an insulated lid which is preferably the same size and shape as the container body, so as to provide an easy fitting mechanism for tightly closing and thus insulating the interior environment of the container. The lid itself has an upper surface and an underside. The solar collector preferably lies on the upper surface of the lid for easy access to the necessary sunlight to power the container's internal battery and refrigeration system. However, in alternate embodiments, the solar collector may be placed in another location, such as the sidewall of the housing. Extending from the upper surface of the lid is a lip which fits snugly with a corresponding mating piece on the container body's upper surface. The lid itself is preferably attached to the container body and may be done so by a system of hinges. In alternate embodiments, the lid may rest within a track on the container body's upper surface or may be attached to protruding tabs on the container body's upper surface which mate with two orifices in two of the lid's corners.

Although the container operates fully on solar power when adequate sunlight is present, it also contains an internal battery which is preferably rechargeable through the solar collector. With adequate sunlight, the battery is continuously recharged, but after sunlight is no longer available, it can still provide power for the refrigeration system for up to 3 to 4 hours without being recharged. This mechanism is preferably located in a compartment between the insulated interior container and the housing. This compartment is insulated from exposure to the environments outside or inside the container. The battery also preferably is rechargeable by other applicable means and may be removed from the compartment to be recharged.

Instead of solar power or in addition to solar power, the present invention may also use a Faraday generator, a wind turbine, human power, e.g. a hand or foot operated crank, a fuel cell or an electric generator that generates electricity when wheels on the device rotate.

In order to more efficiently conserve battery power, the present invention has an "energy save mode" characterized by a thermostat that measures the temperature outside the container and adjusts the operation of the refrigeration system according to its temperature readings. In this manner, when the outside temperature falls below a certain level, the fans, vents and heat sinks of the refrigeration system will be slowed down and even possibly shut off so that battery power is conserved and not wasted when it is not necessary. An alternate purpose for this mechanism is to ensure that the food or drink within the container does not become too cold for serving.

Although the container of the present invention is powered by both solar energy gathered by at least one solar collector as well as an internal battery, it also has both AC and DC connectors extending from the outer surface of the housing. These cords are preferably retractable and are able to provide power to the refrigeration system of the container when connected to an appropriate outlet. For instance, the DC connector is able to provide power to the container through connection with a car cigarette lighter, adding yet another means for fueling the refrigeration system.

The container's interior is refrigerated by a thermoelectric cooling unit (TEC), which employs heat sinks, fans and vents to lower the container's internal temperature to a desirable level. The TEC operates by creating a temperature gradient between the insulated environment and the outside environment which allows hot air to be drawn into orifices along the interior container's sidewall or sidewalls. As air inside the container warms, it is drawn over the interior heat sink where heat is extracted. The heat is pulled through the TEC to the outside heat sink where the heat is transferred to the outside air. The newly cooled air on the inside is recirculated. Simultaneously, cool air is being blown in from the vents and the fan, maintaining a temperature well below that of the outside environment.

An additional feature of the present invention is a control panel or user interface preferably located on the upper surface of the container lid. This panel houses a number of controls and displays which allow a user to both customize the activity of the container as well as be informed of important conditions with regard to the container's operation. The control panel preferably allows a user to turn on or off the TEC, to adjust the temperature within the cooler, to set a temperature for the cooler to remain at, to set a temperature at which the energy save mode begins operating, and to set a timer that will notify a user when a product is sufficiently chilled for use. Examples of preferable displays include temperature readings for both the inside and outside environments of the container, a reading of the amount of energy remaining in the battery, as well as a notification if the lid of the container is not sufficiently closed. Another instrument that may be present on the device is a "carbon offset meter" i.e., a device that displays the total amount of carbon the user has offset since the cooler has been in use. Alternate embodiments will expand on the user interface options possible.

The present invention uses what can be designated as Self-sustaining Temperature Stabilization (STS) Systems. This technology is scalable, and adjustable to accommodate a wide variety of temperature and volume requirements. This flexibility enables the technology to be implemented in a multitude of applications, wherever there is a need to maintain a specific temperature different from the ambient. Whenever surrounding environment provides adequate and harnessable energy such as solar, wind, wave, and/or human power the STS System can be employed.

Applicable markets for the present invention include but are not limited to:

1. Medical transport and storage—blood, organs, vaccines, and other temperature sensitive materials currently have no way of being transported with the guarantee that there won't be a power loss while in transit domestically. The current method of transporting the temperature sensitive materials is through the use of Dry Ice. Dry Ice can be a serious health hazard, as it melts it releases Carbon Dioxide. Also, the temperature cannot be adjusted specific to the materials being transported. Also, in many rural destinations in need of medical supplies there is not a readily available power supply.
2. Military package deployment of temperature sensitive materials. On average the DoD spends $60 m annually on casualty prevention, which includes the shipment of temperature sensitive materials.
3. Produce transport—Both overseas freight, and domestic. Not only will this reduce costs by reducing the fuel consumed to power refrigeration systems on transport vehicles/vessels, but there will also be a reduction in the carbon footprint left behind during the transport.
4. Commercial catering. With a large number of events taking place outside, they require generators or other power supply to run the refrigerators, this costs the caterers a significant amount of money. With the use of our technology, scaled up in size, the caterers can provide their services at a lower cost while providing a carbon neutral, and environmentally friendly presence.
5. Remote refrigeration in underdeveloped and rural locations.
6. General everyday consumer use. Everyone needs a cooler to keep their food and drinks cold while at the beach or out on the boat, but no one likes to stop and get ice every time they head out. This product solves these issues, while also providing power to charge 12v accessories.

OBJECTS OF THE INVENTION

It is therefore an object of the present invention to provide a container for keeping food, beverages and other desired objects cool despite the conditions that may exist outside the container.

It is a further object of the present invention to provide a container that maintains a refrigerated internal environment through the use of a thermoelectric refrigeration system that utilizes heat sinks, fans and vents.

It is a further object of the present invention to provide a container that refrigerates products through use of a solar-powered refrigeration system.

It is a further object of the present invention to provide a cooler that can alternatively utilize both solar power as well as a rechargeable internal battery that can operate uncharged for up to 3 to 4 hours.

It is a still further object of the present invention to provide a solar-powered refrigeration container that has the ability to conserve battery power if the outside temperature falls below a certain level.

It is still a final object of the present invention to provide a solar-powered refrigeration container that has a control panel from which a user can manipulate a variety of the functionalities of the container itself.

DETAILED DESCRIPTION OF THE INVENTION

Figure 1:
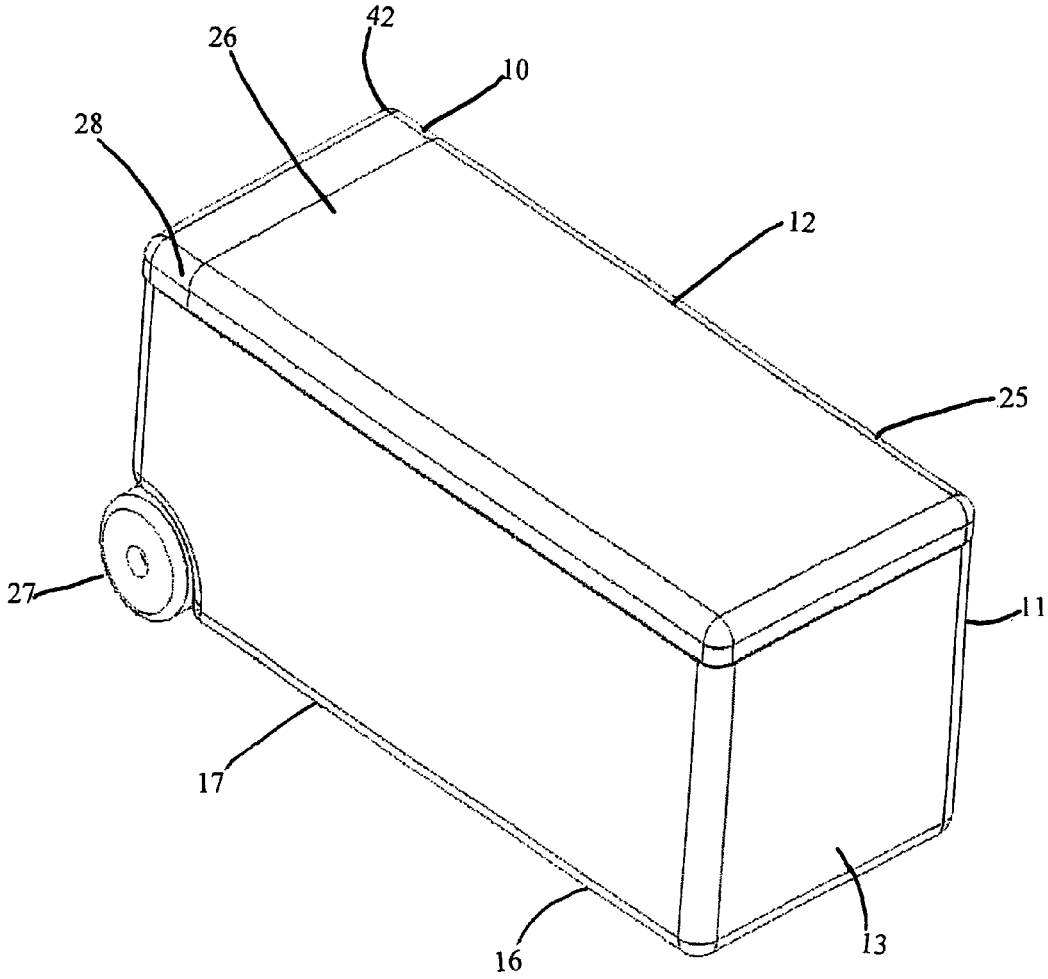
FIG. 1 shows a perspective view of the preferred embodiment of the present invention with lid in the closed position.
Figure 2:
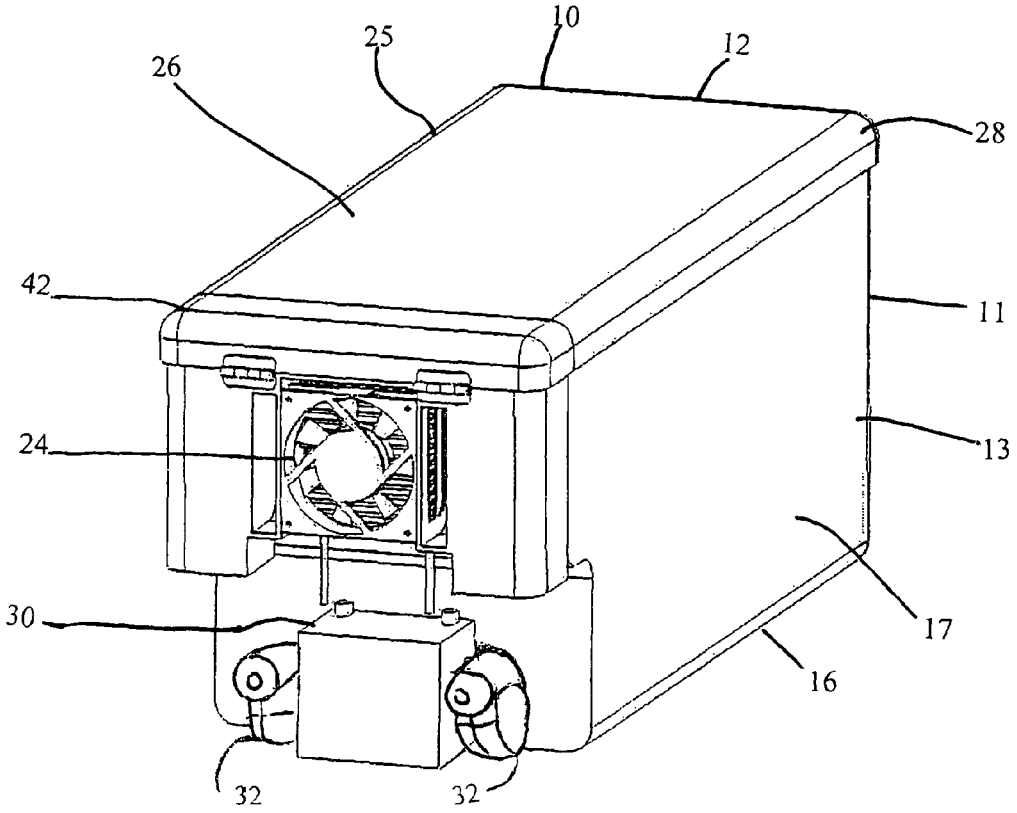
FIG. 2 shows a perspective view of the preferred embodiment of the present invention with the lid in the closed position.
Figure 3:
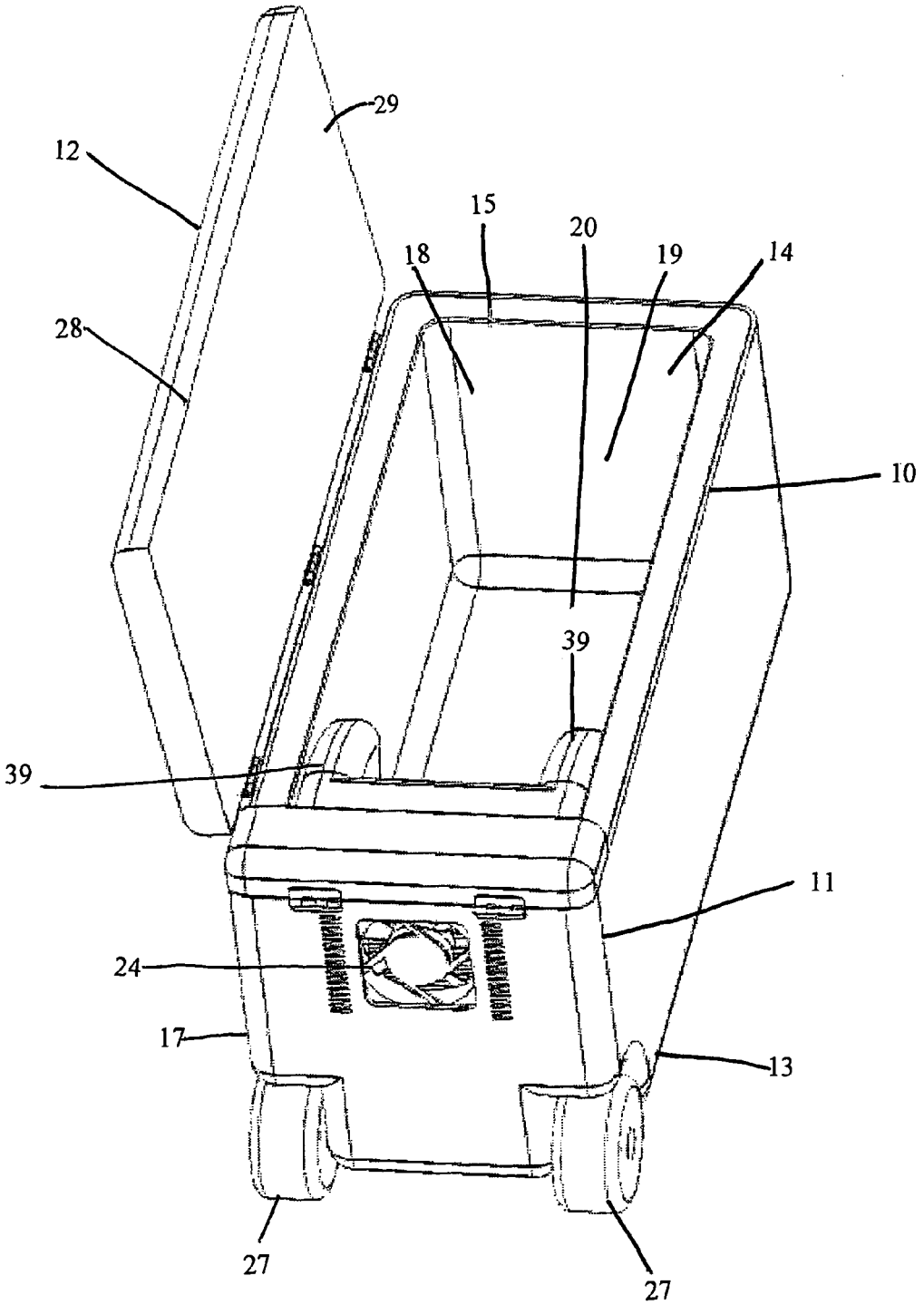
FIG. 3 shows a top view of the preferred embodiment of the present invention with the lid in the open position.
Figure 4:
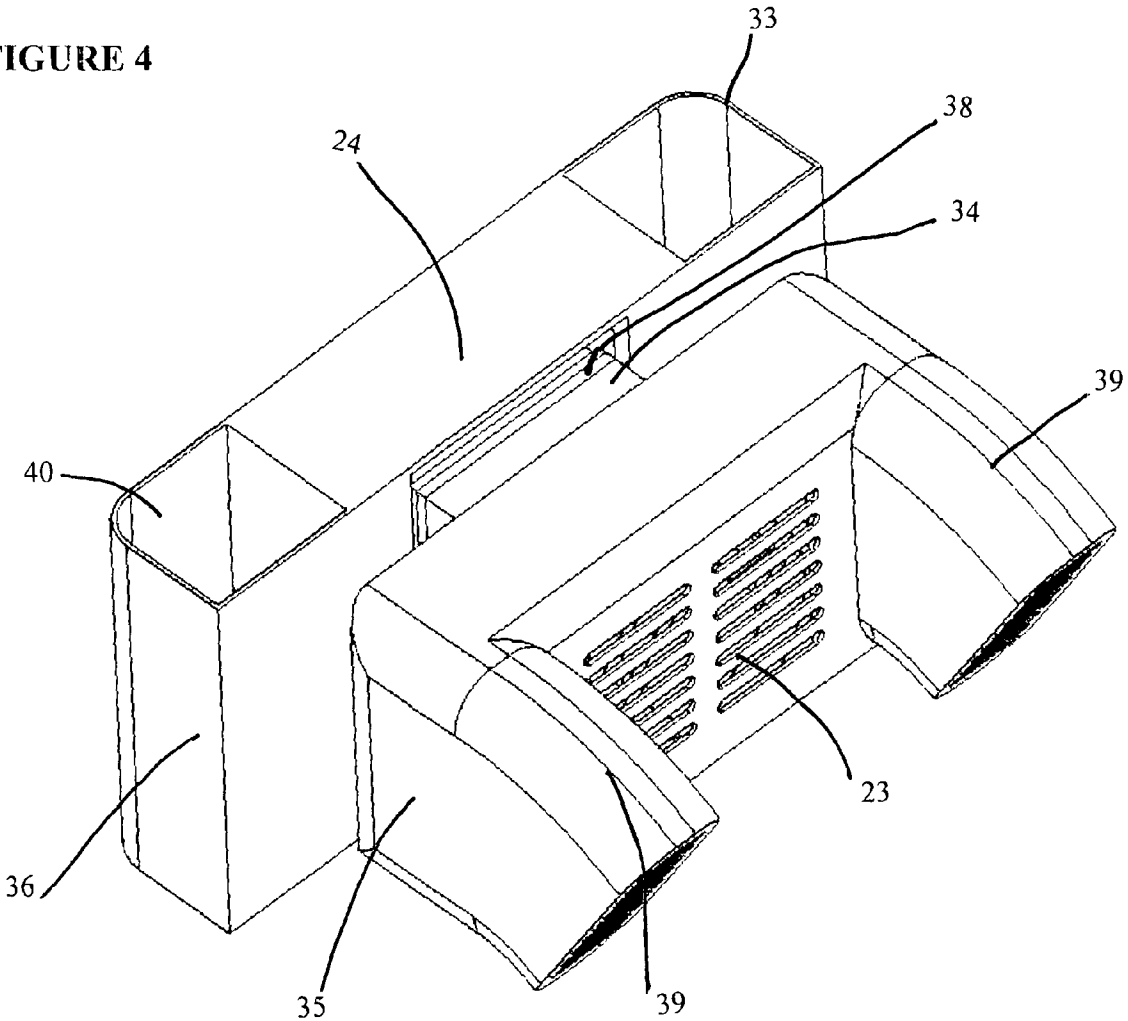
FIG. 4 shows a transparent perspective view of the refrigeration system of the present invention.
Figure 5:
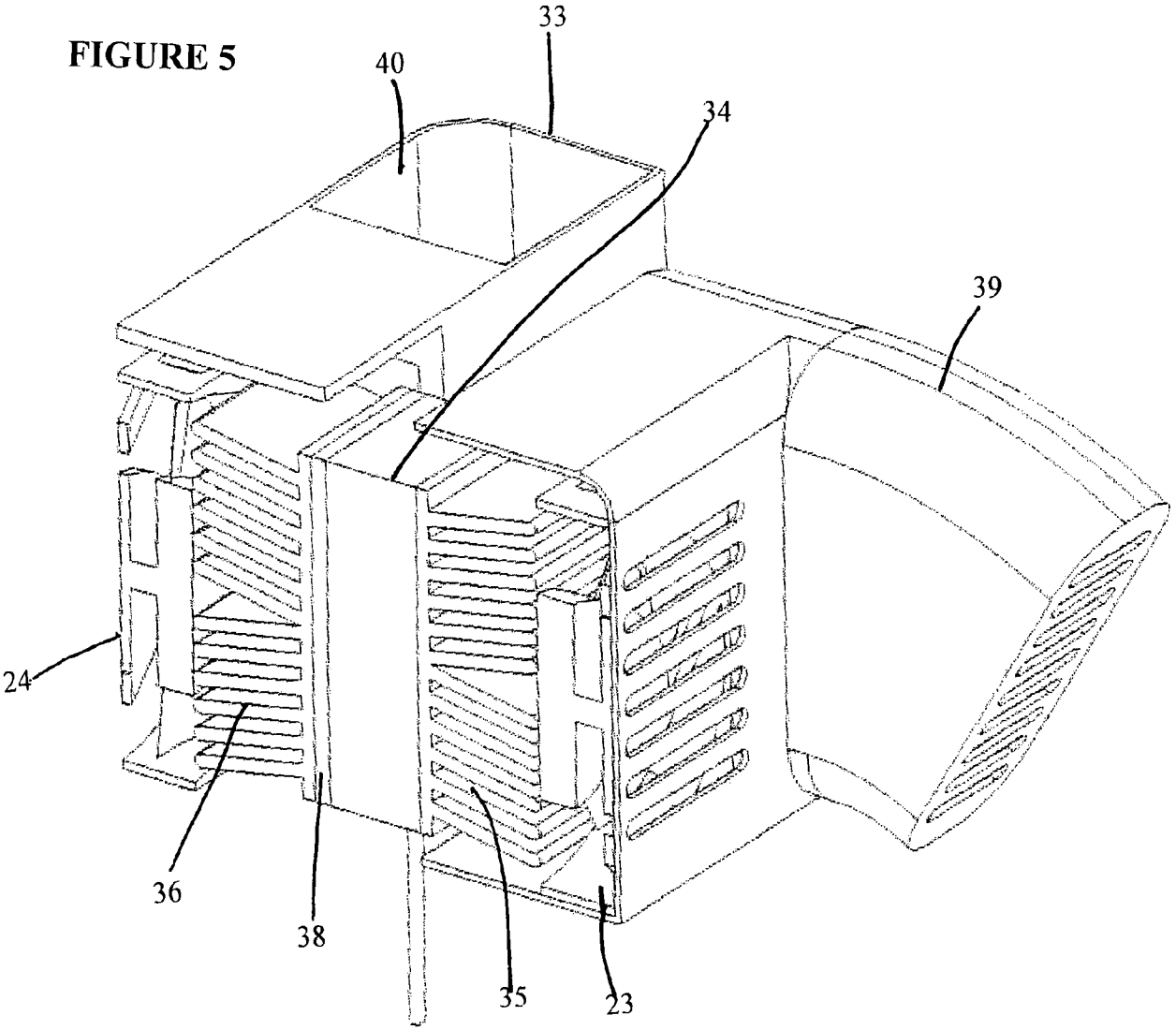
FIG. 5 shows a side cross-sectional view of the refrigeration system of the present invention.
Figure 6:
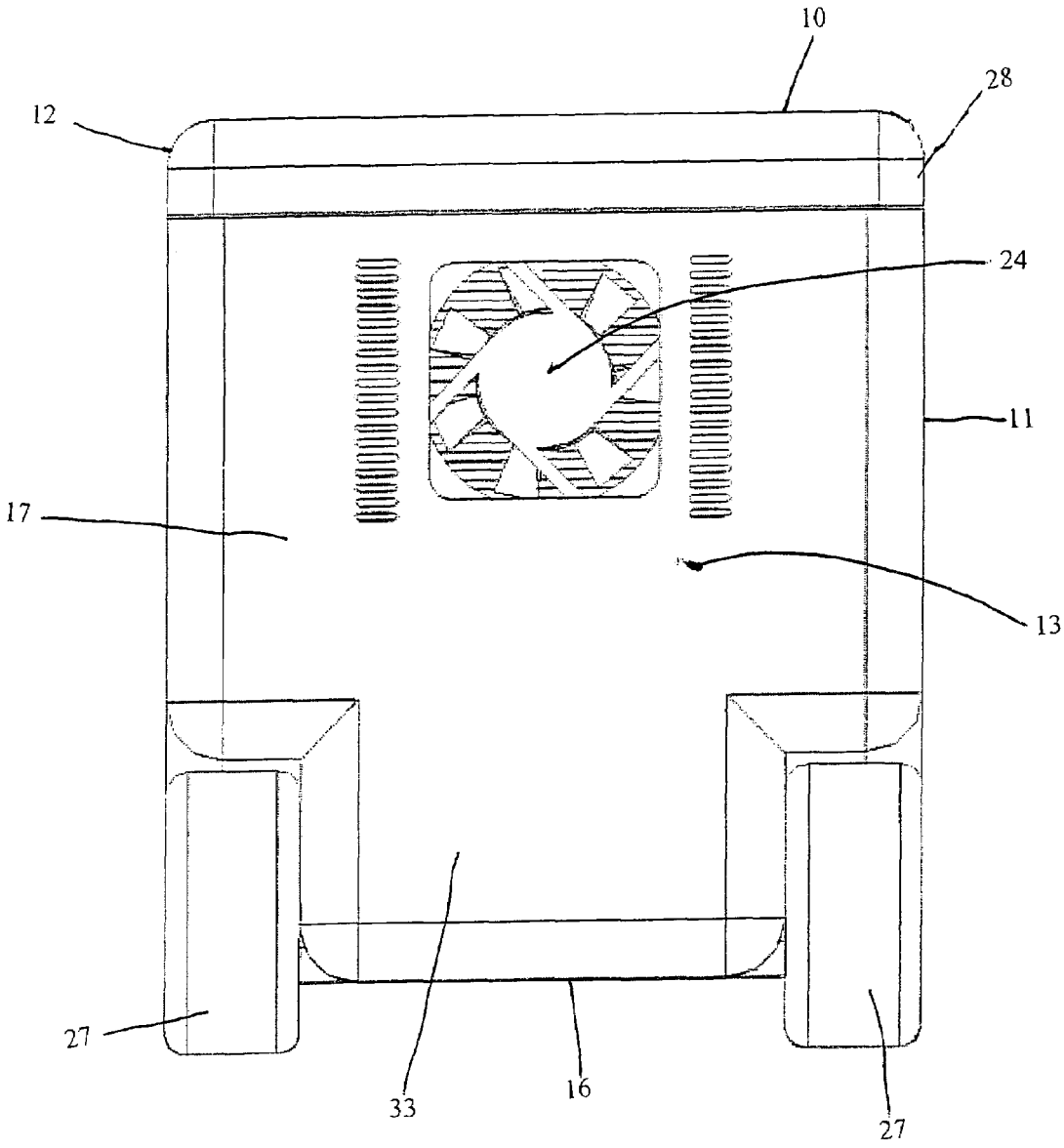
FIG. 6 shows a rear view of the preferred embodiment of the present invention.
Figure 7:
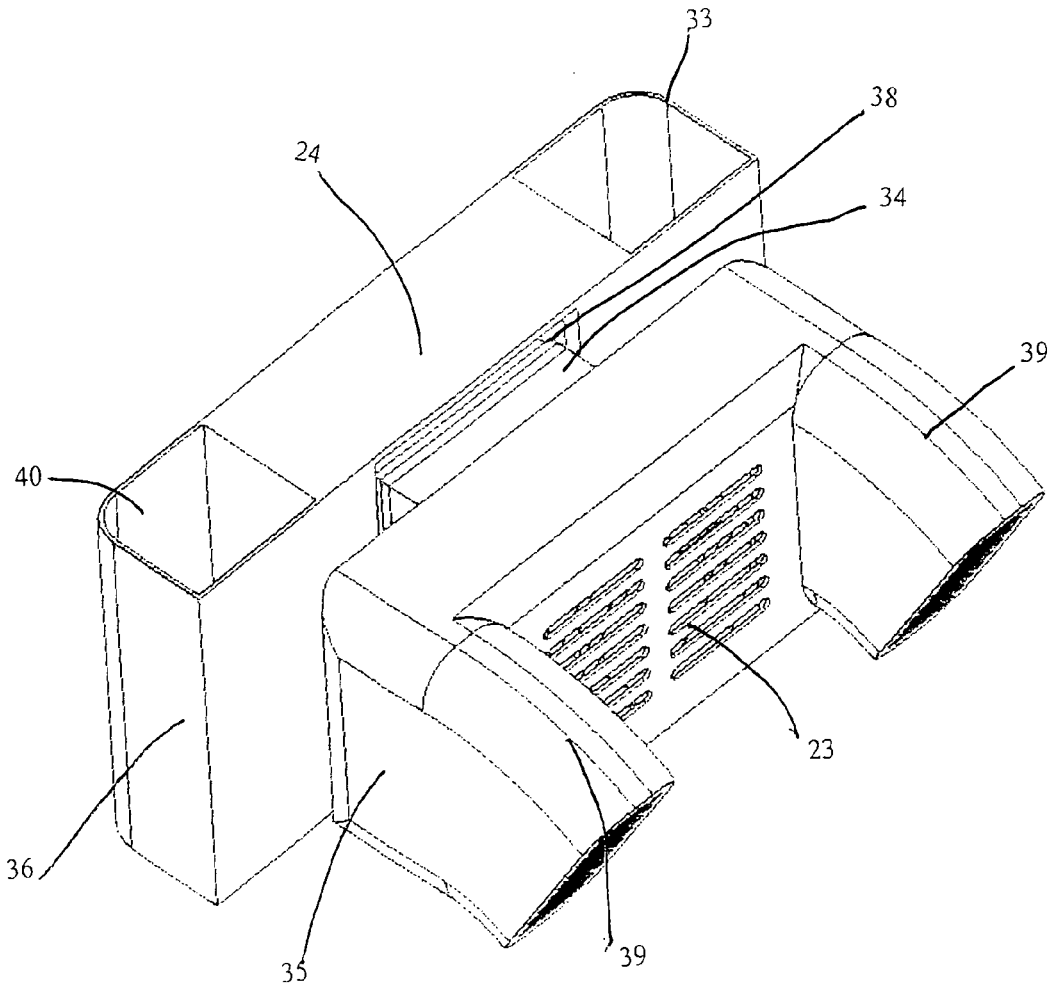
FIG. 7 shows a transparent perspective view of the refrigeration system of the present invention.
Figure 8:
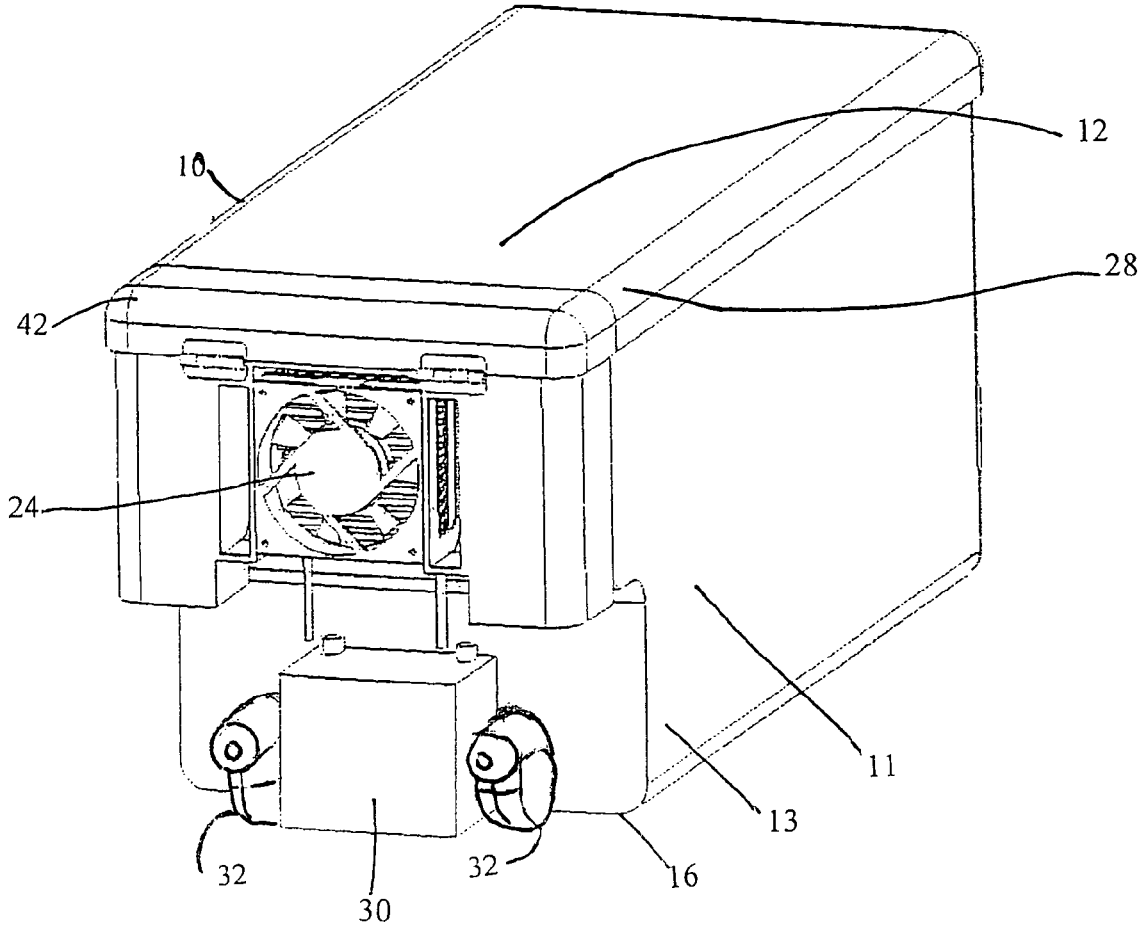
FIG. 8 shows a rear cross-sectional view of the internal battery compartment of the present invention.
Figure 9:
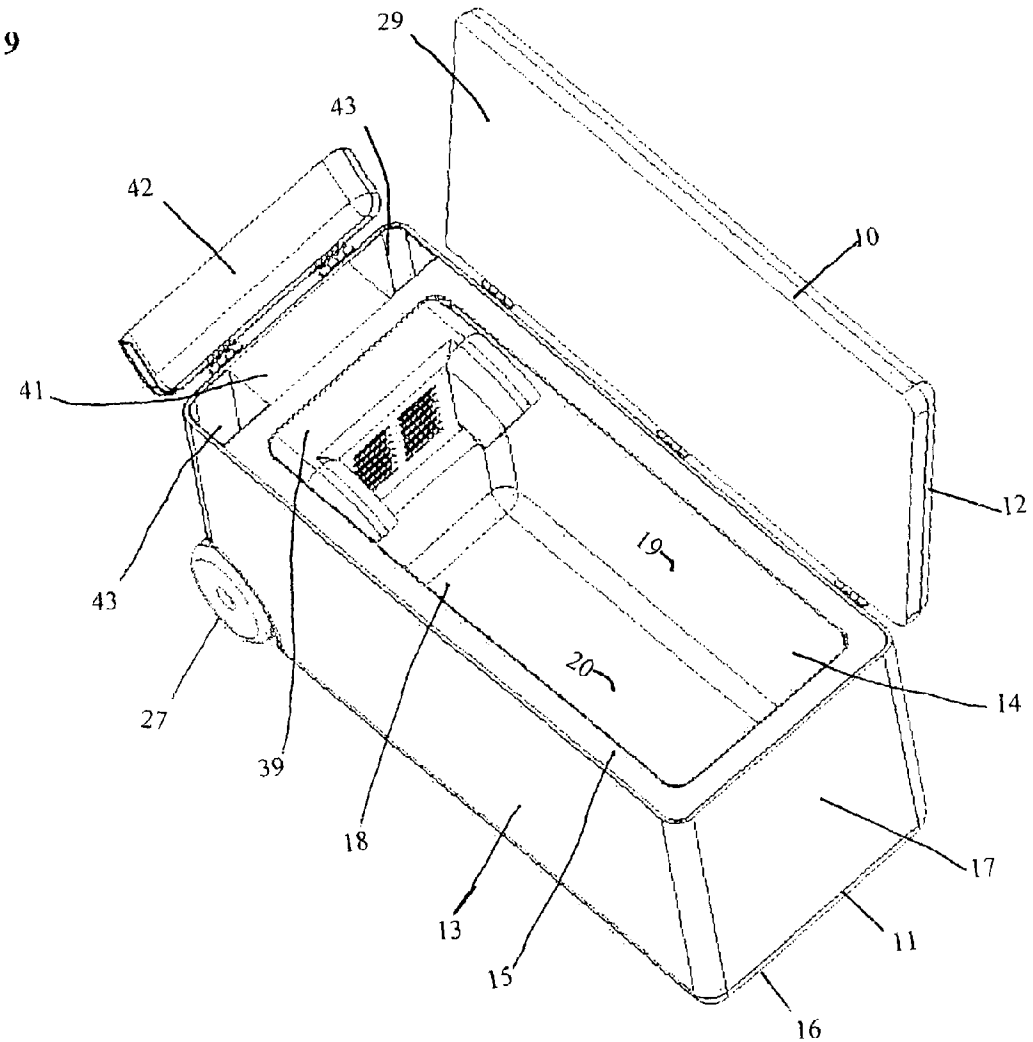
FIG. 9 shows a top view of the preferred embodiment of the present invention with both the container lid and the control panel door in the open position.
Figure 10:
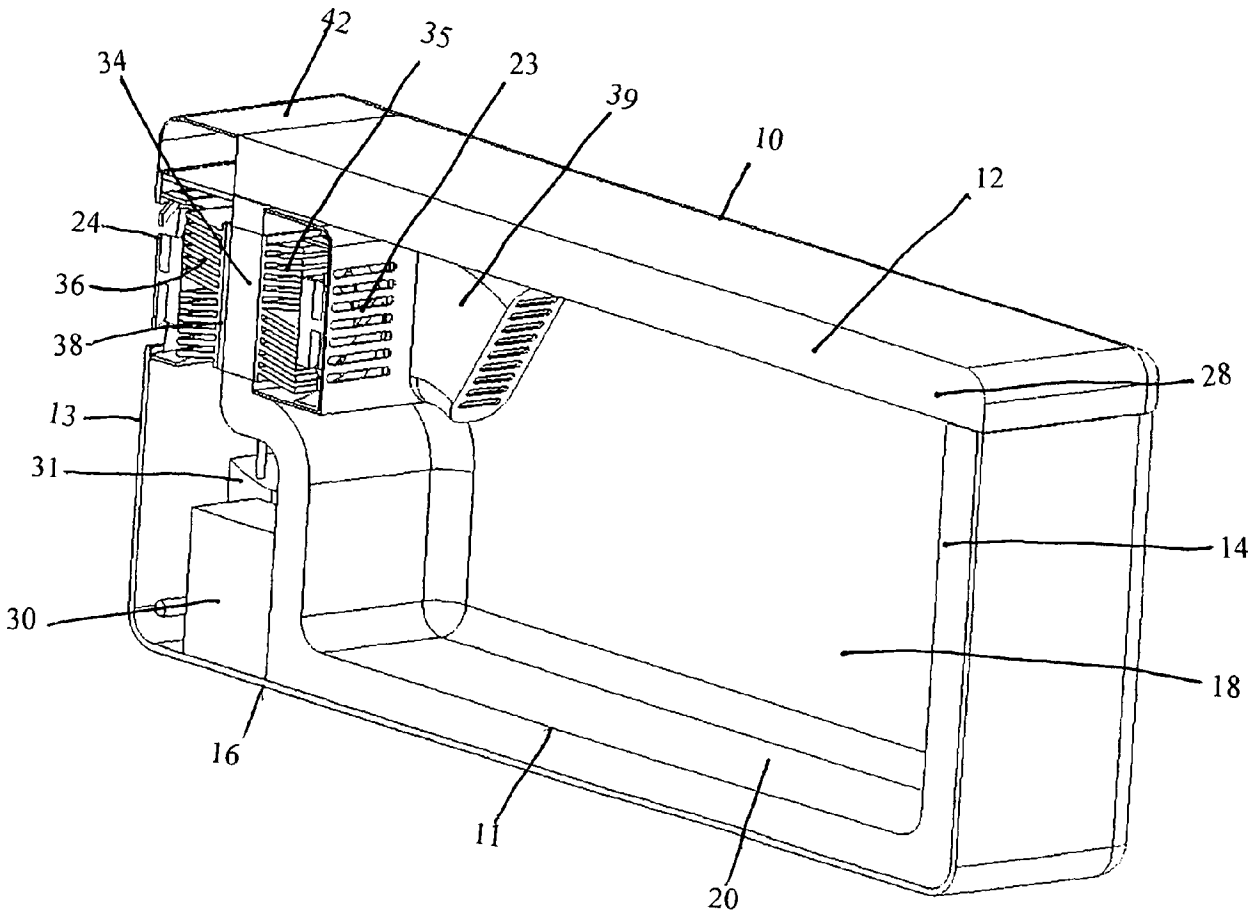
FIG. 10 shows a cutaway view of the preferred embodiment of the present invention.
Figure 11:
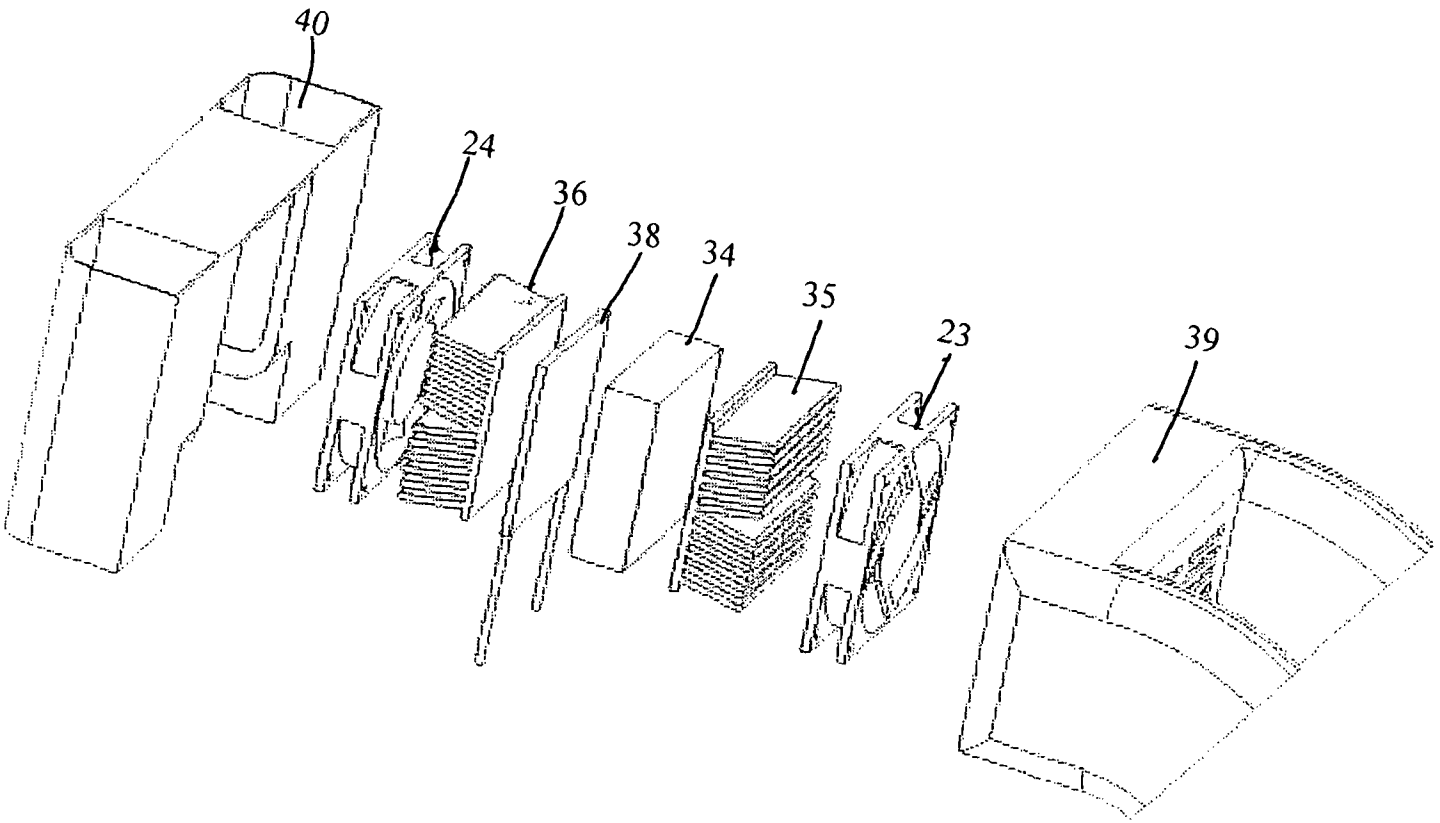
FIG. 11 shows an exploded view of the refrigeration system of the present invention.
Figure 12:
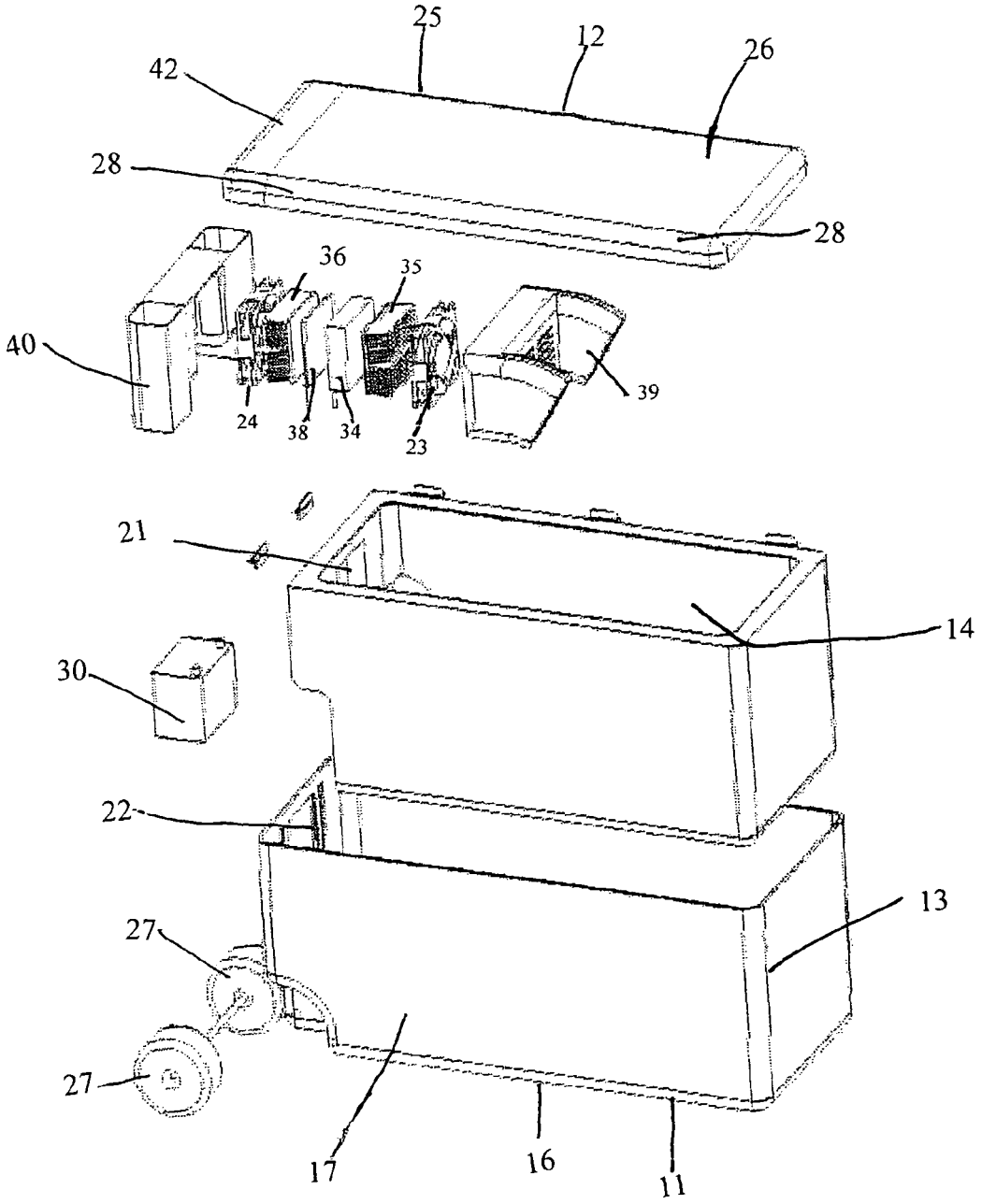
FIG. 12 shows an exploded view of the preferred embodiment of the present invention.
Figure 13:
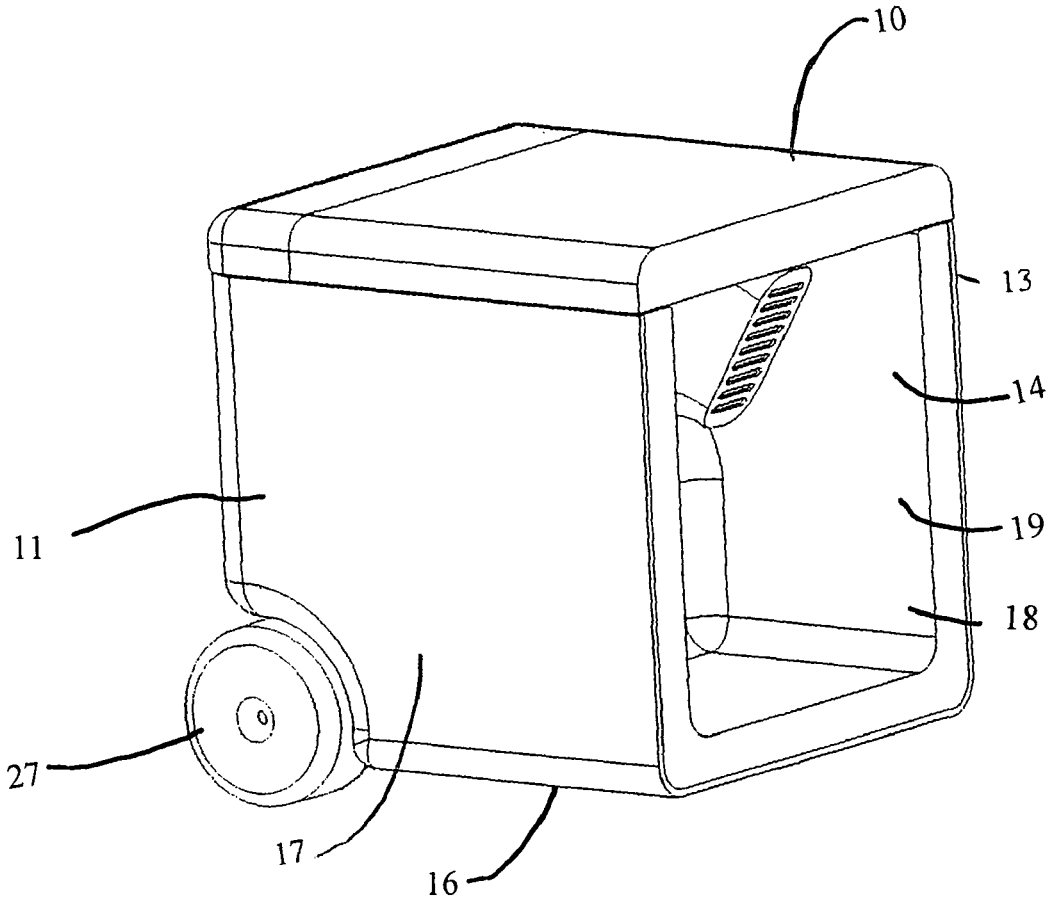
FIG. 13 shows a transparent perspective view of the preferred embodiment of the present invention.
Figure 14:
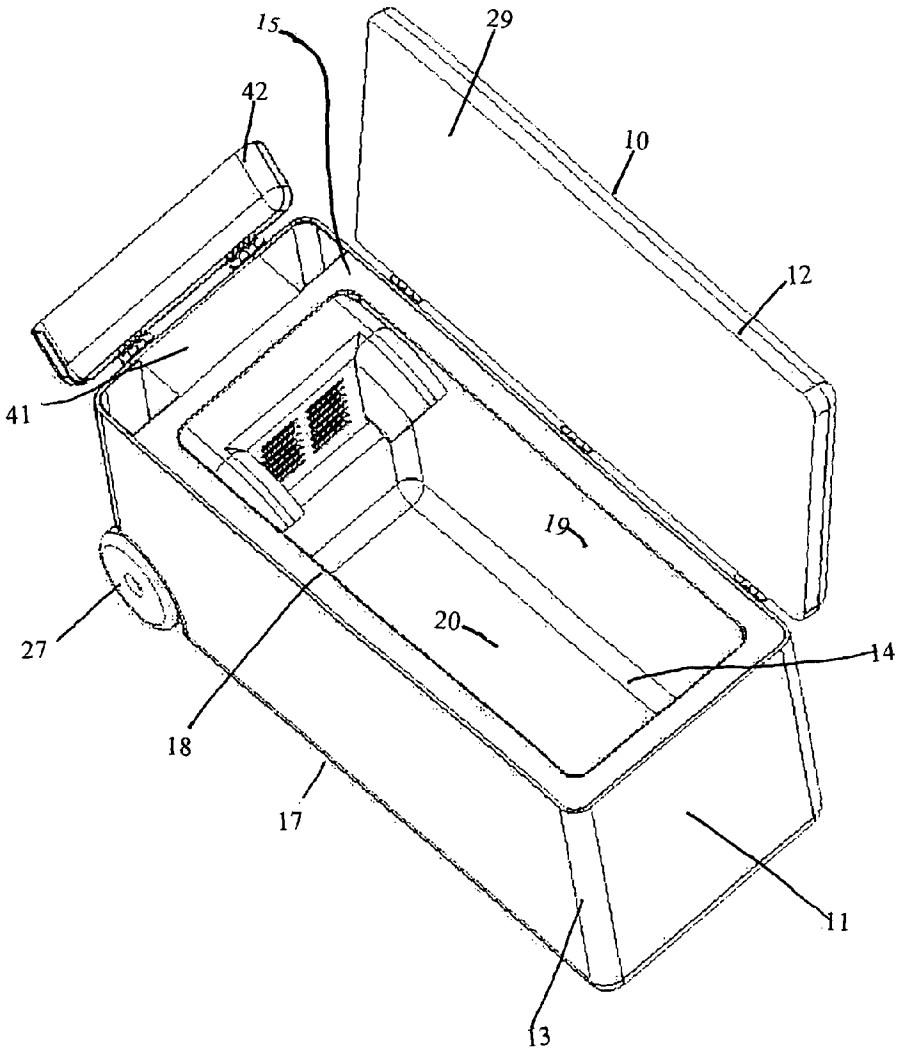
FIG. 14 shows a perspective view of the preferred embodiment of the present invention.
Figure 15:
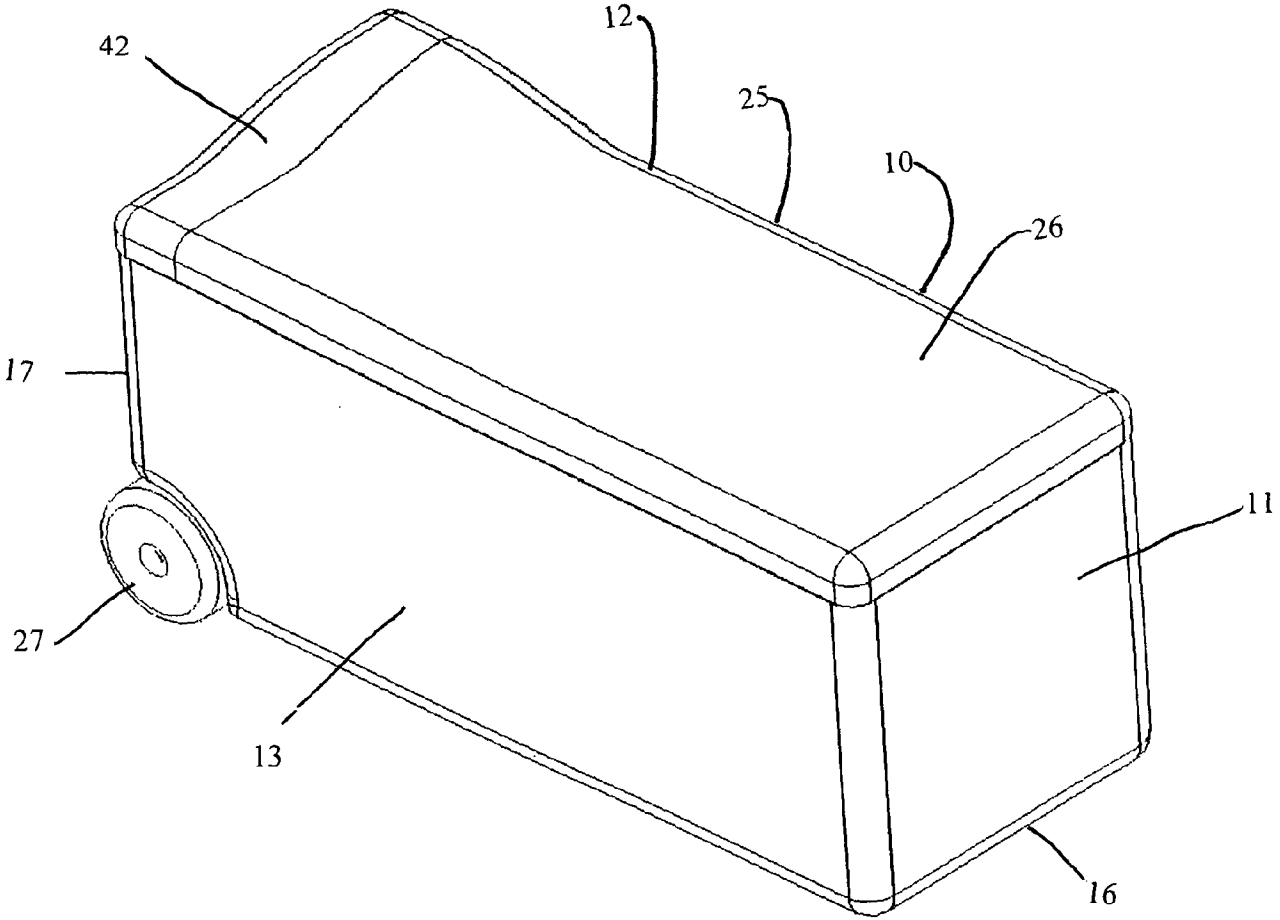
FIG. 15 shows a perspective view of the preferred embodiment of the present invention with the container lid in the closed position.
Figure 16:
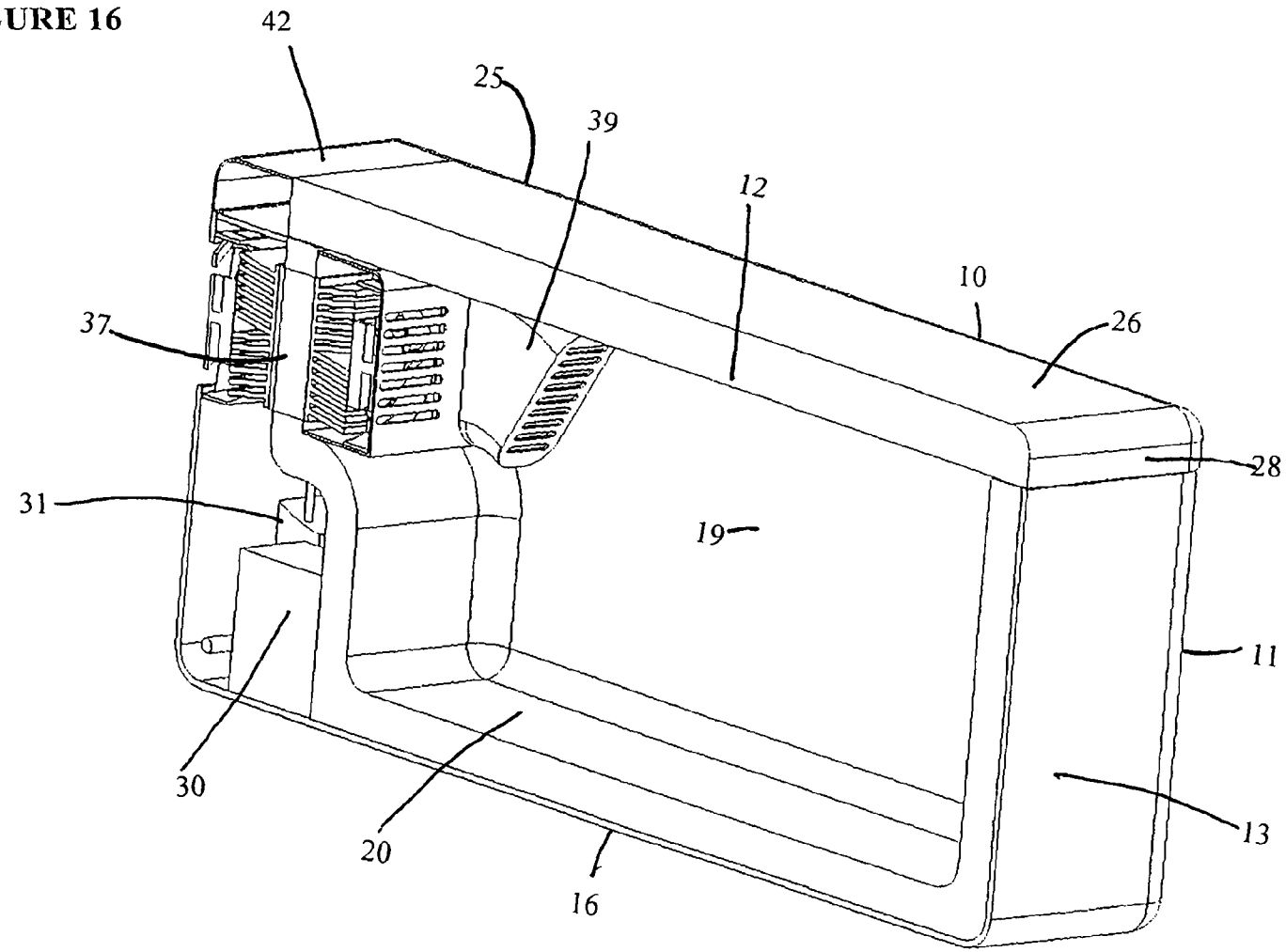
FIG. 16 shows a cutaway perspective view of the preferred embodiment of the present invention.
Figure 17:
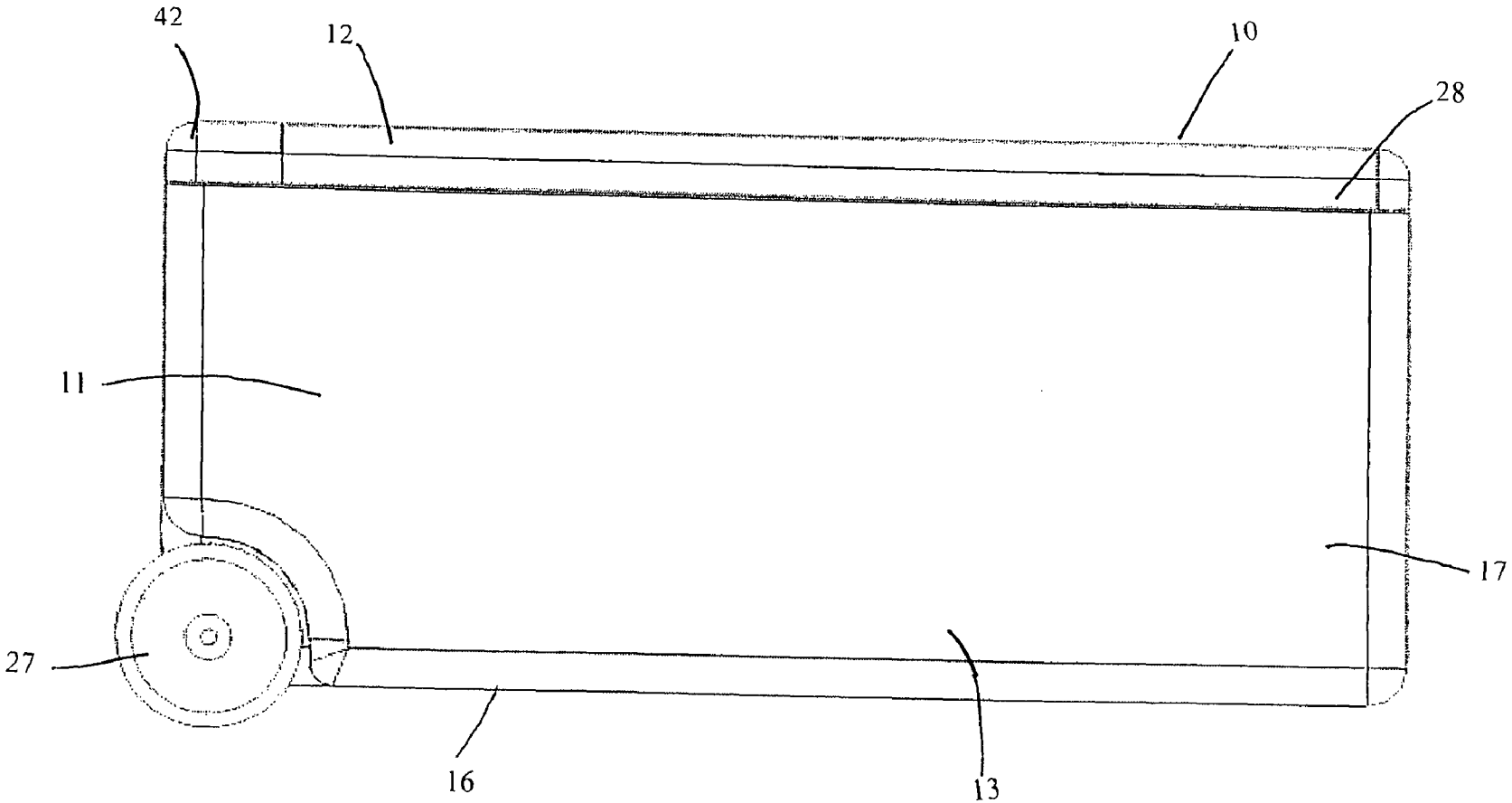
FIG. 17 shows a side view of the preferred embodiment of the present invention.
Figure 18:
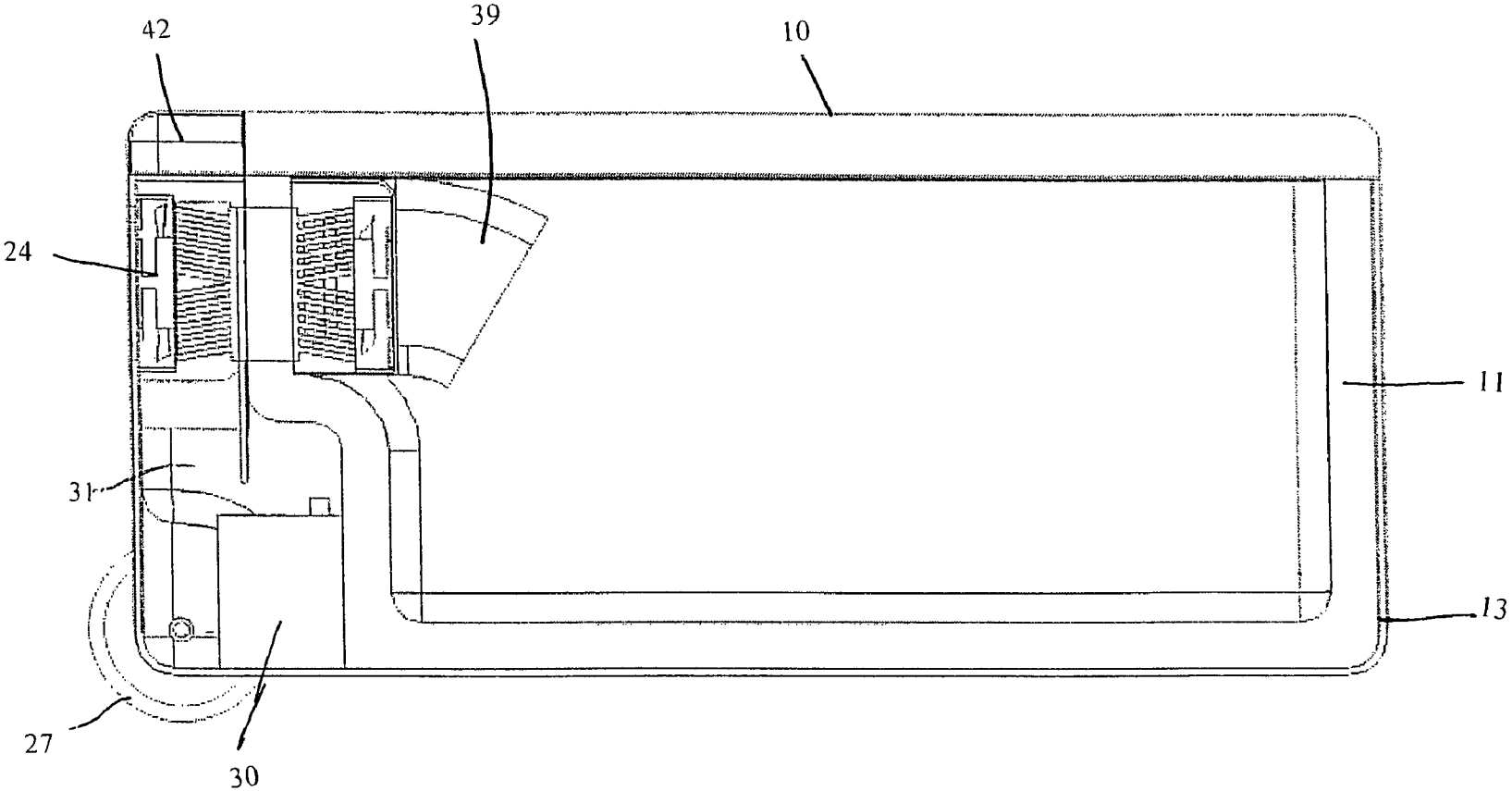
FIG. 18 shows a side cutaway view of the preferred embodiment of the present invention.
Figure 19:
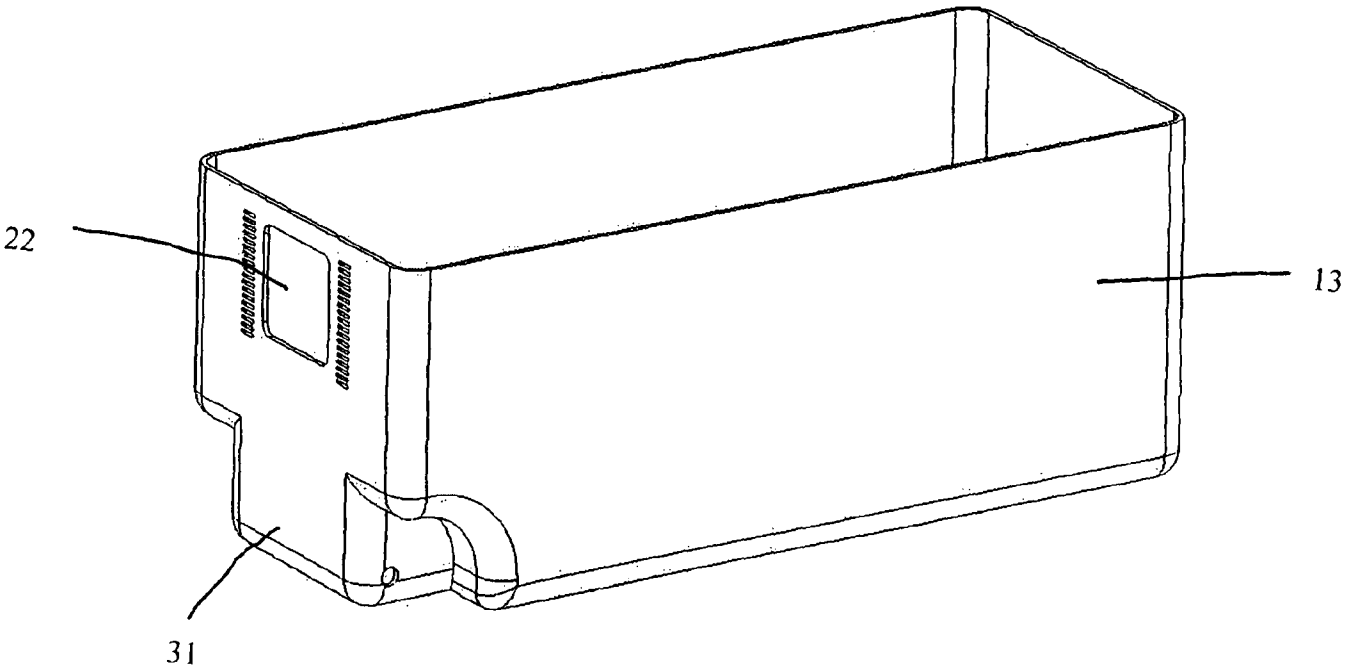
FIG. 19 shows a perspective view of the housing of the present invention.
Figure 20:
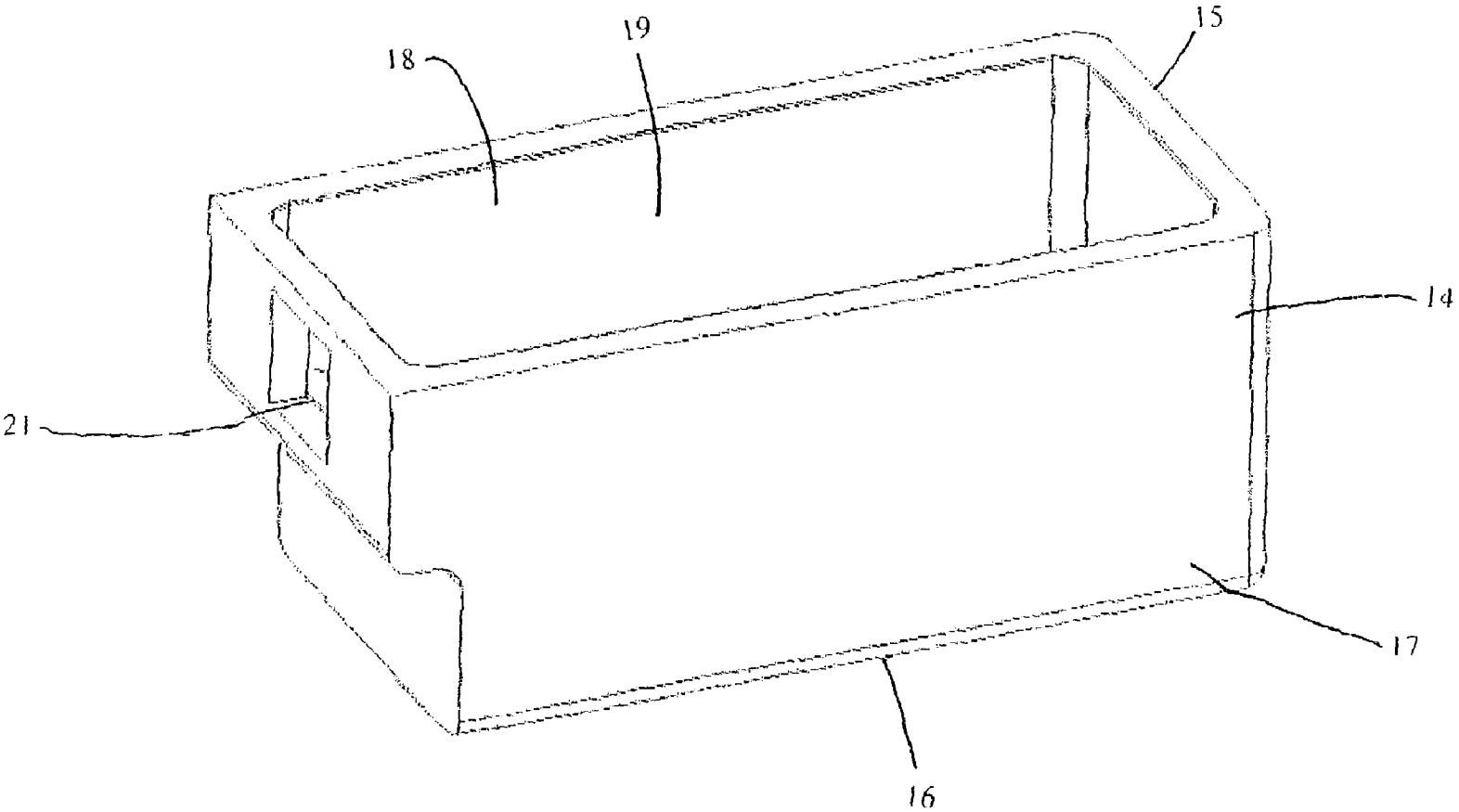
FIG. 20 shows a perspective view of the insulated interior container of the present invention.
Figure 21:
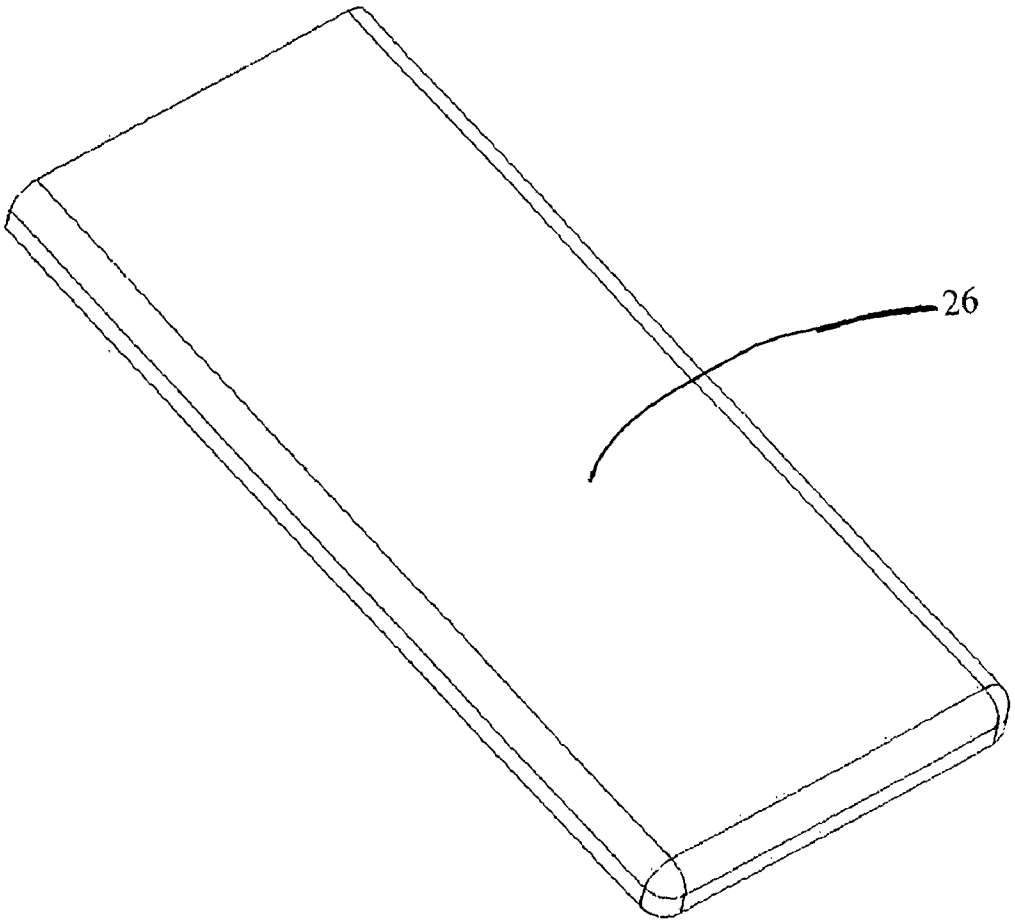
FIG. 21 shows a perspective view of the solar collector of the present invention.
Figure 22:
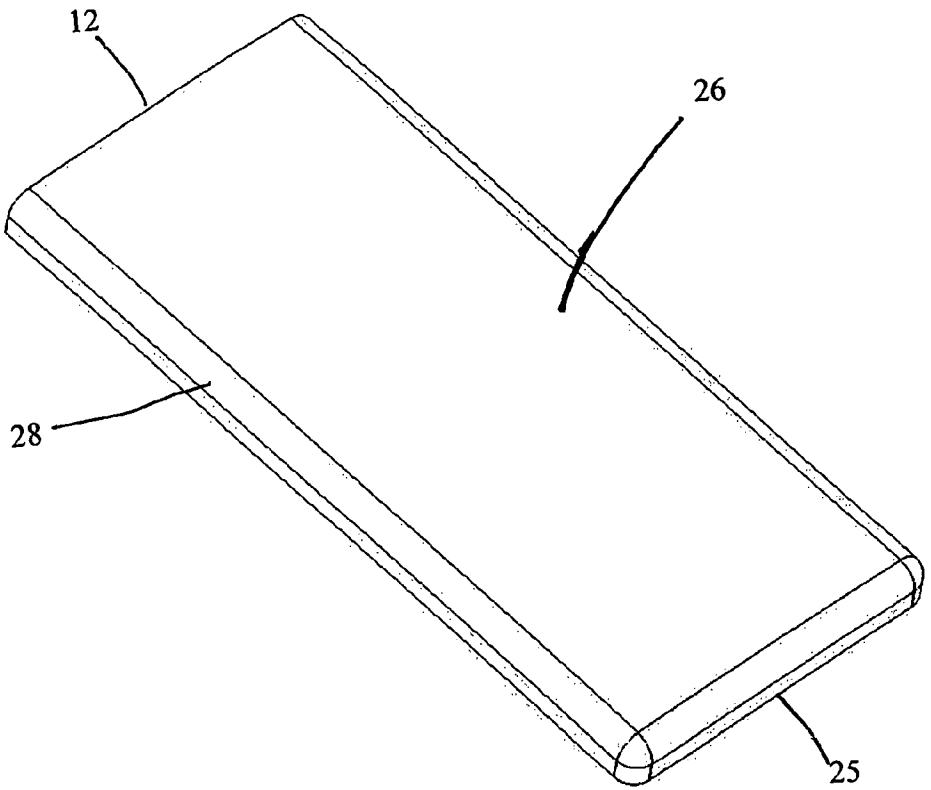
FIG. 22 shows a perspective view of the container lid of the present invention.
Figure 23:
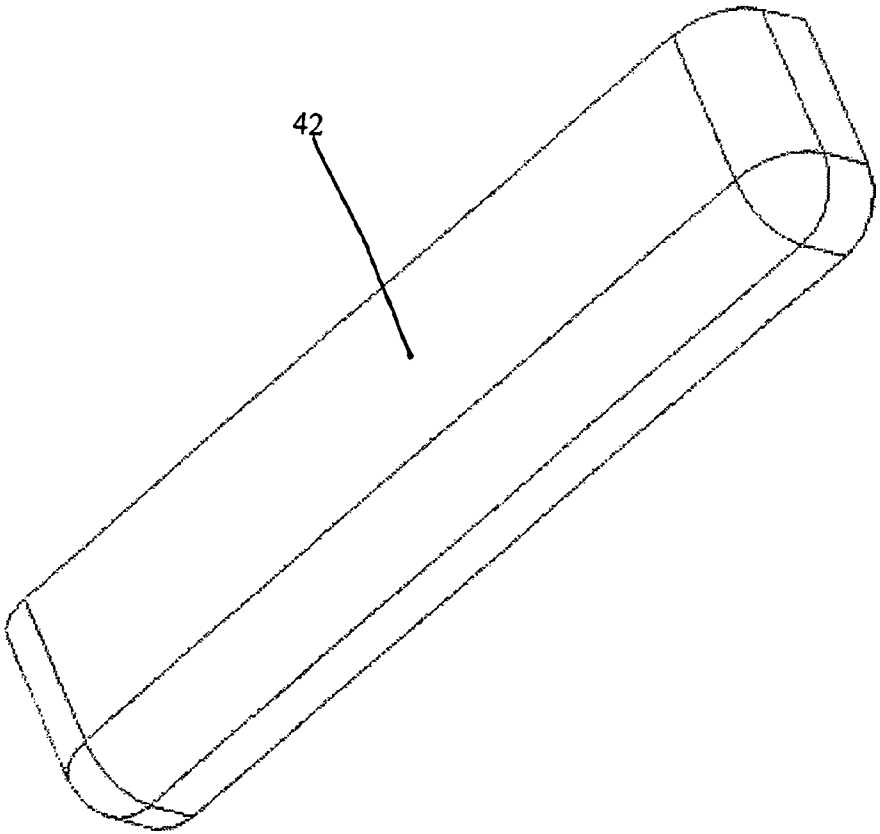
FIG. 23 shows a perspective view of the door of the control panel of the present invention.
Figure 24:
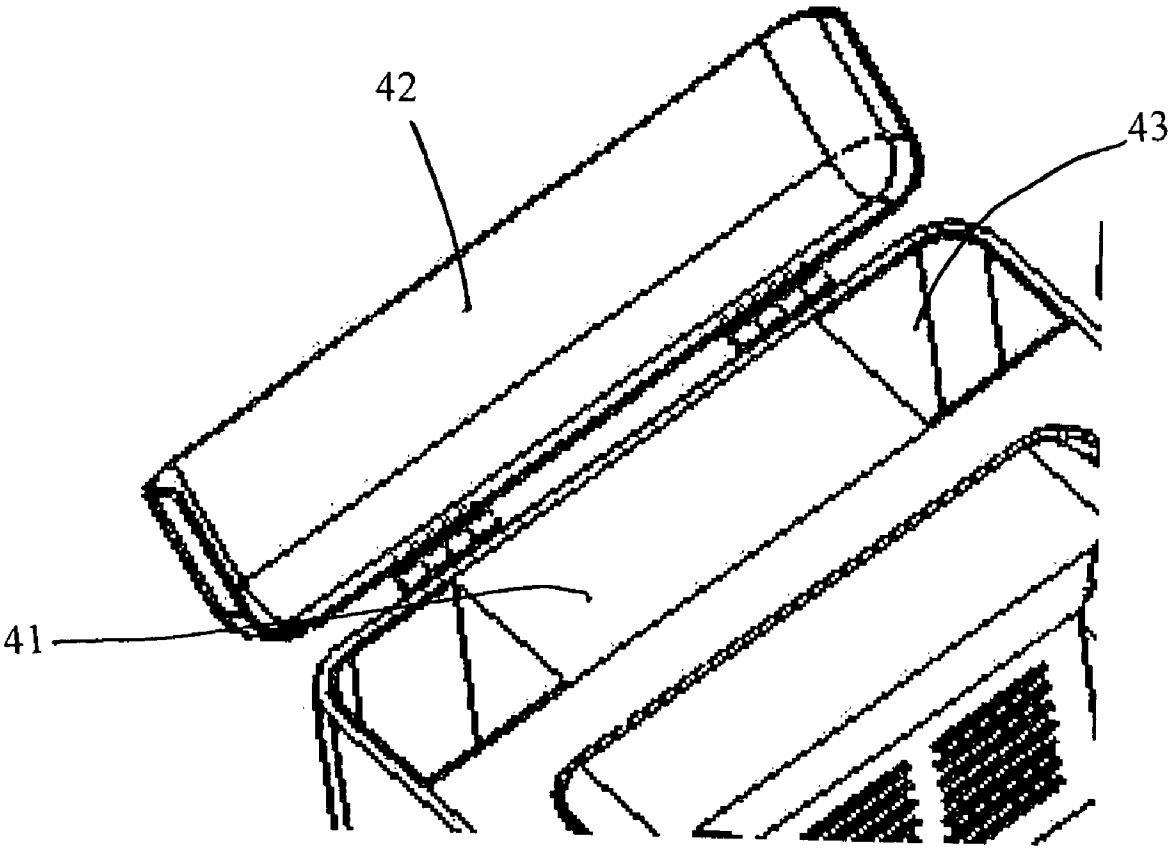
FIG. 24 shows a perspective view of the control panel of the present invention with the control panel door in the open position.
Figure 25:
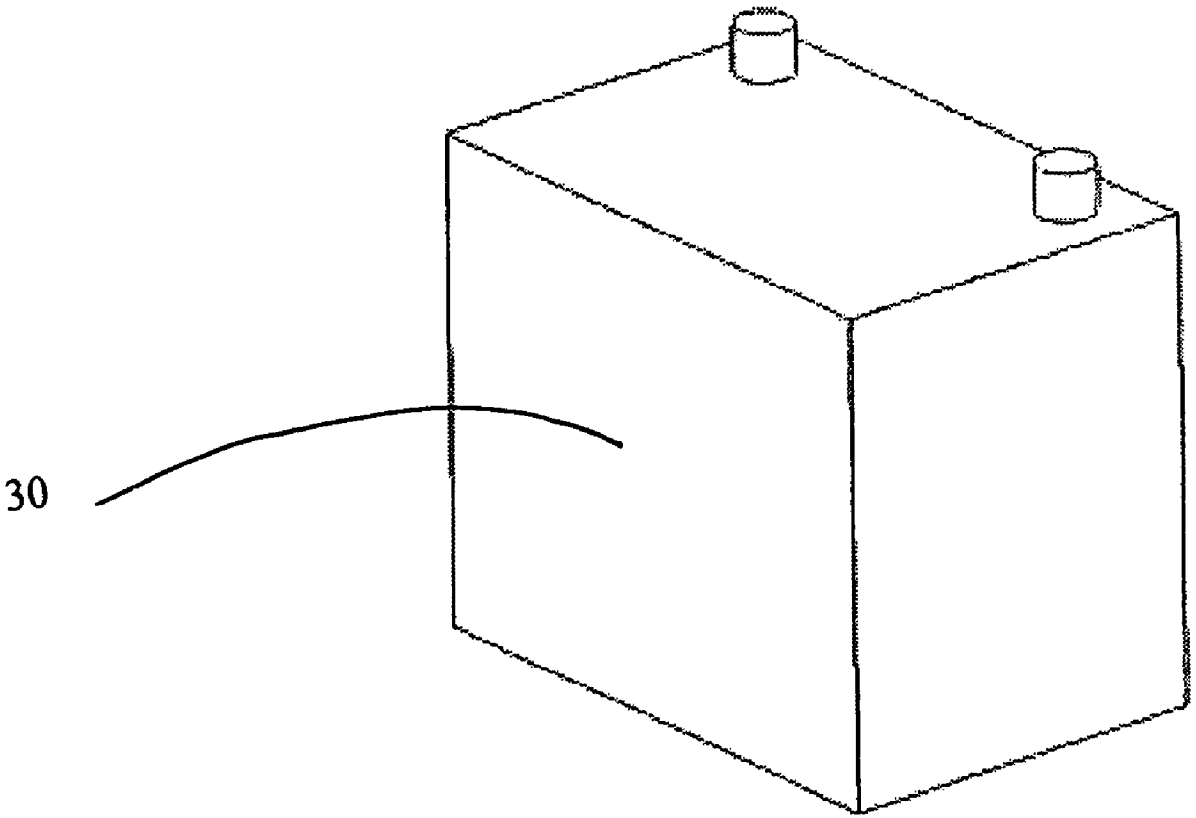
FIG. 25 shows a perspective view of the internal battery of the present invention.
Figure 26:
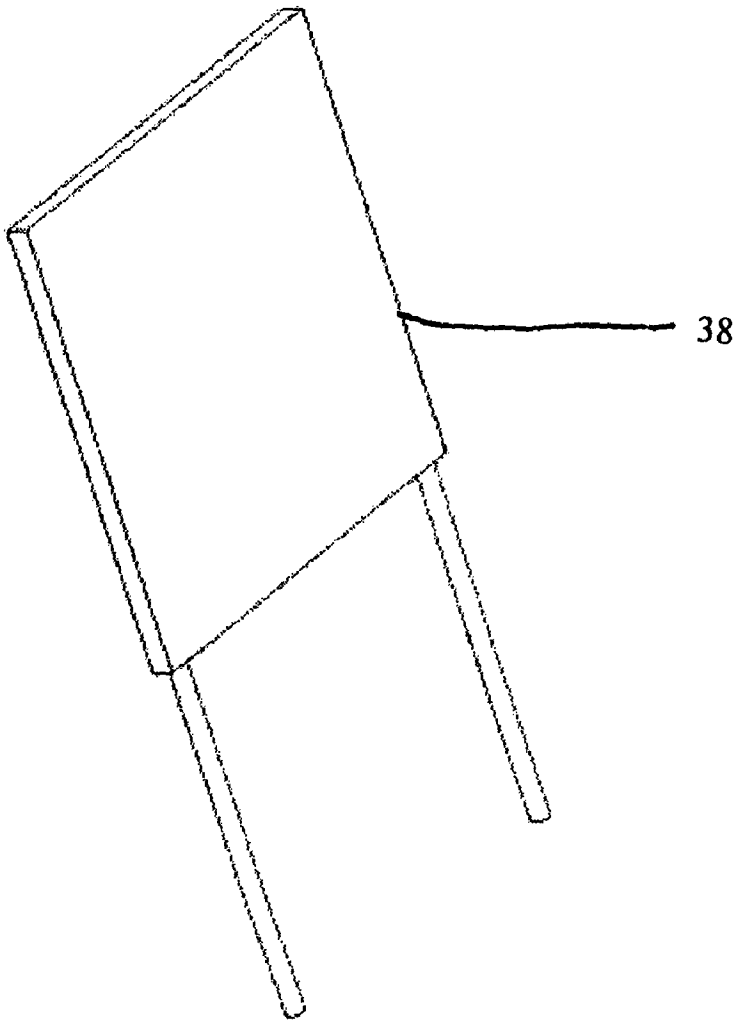
FIG. 26 shows a perspective view of the thermoelectric cooling units of the present invention.
Figure 27:
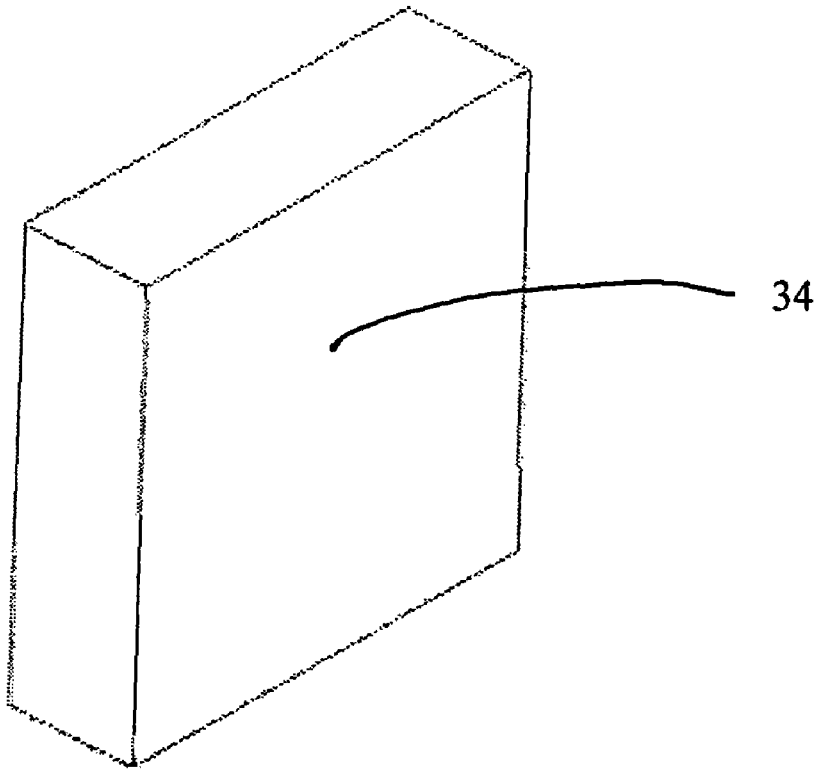
FIG. 27 shows a perspective view of the spacer block of the present invention.
Figure 28:
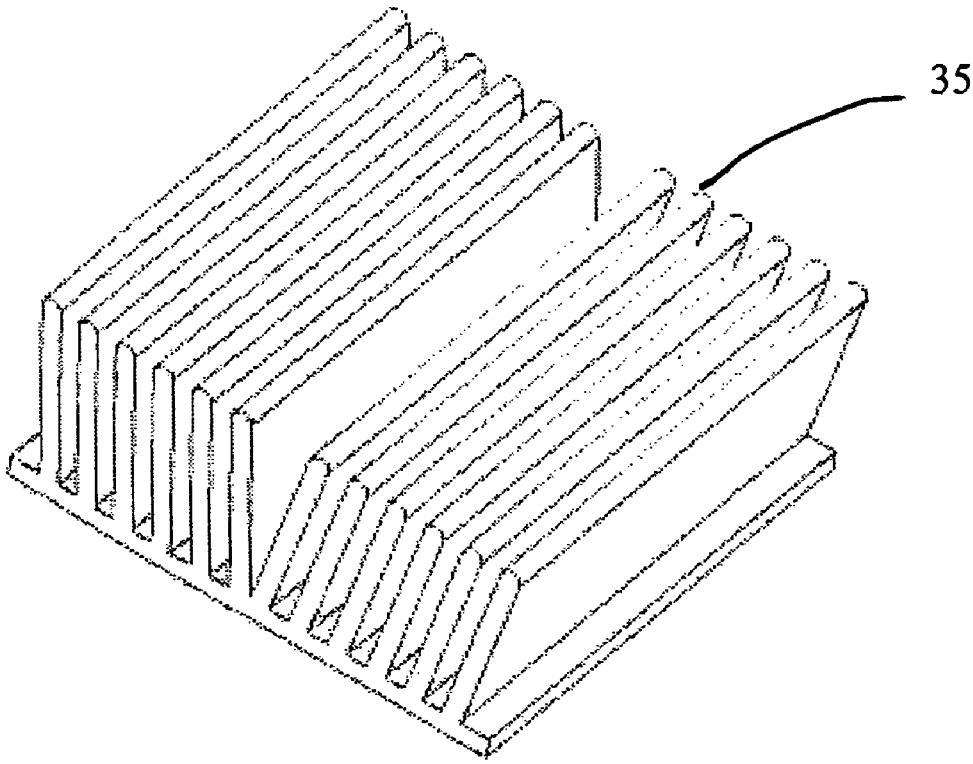
FIG. 28 shows a perspective view of a heat sink of the present invention.
Figure 29:
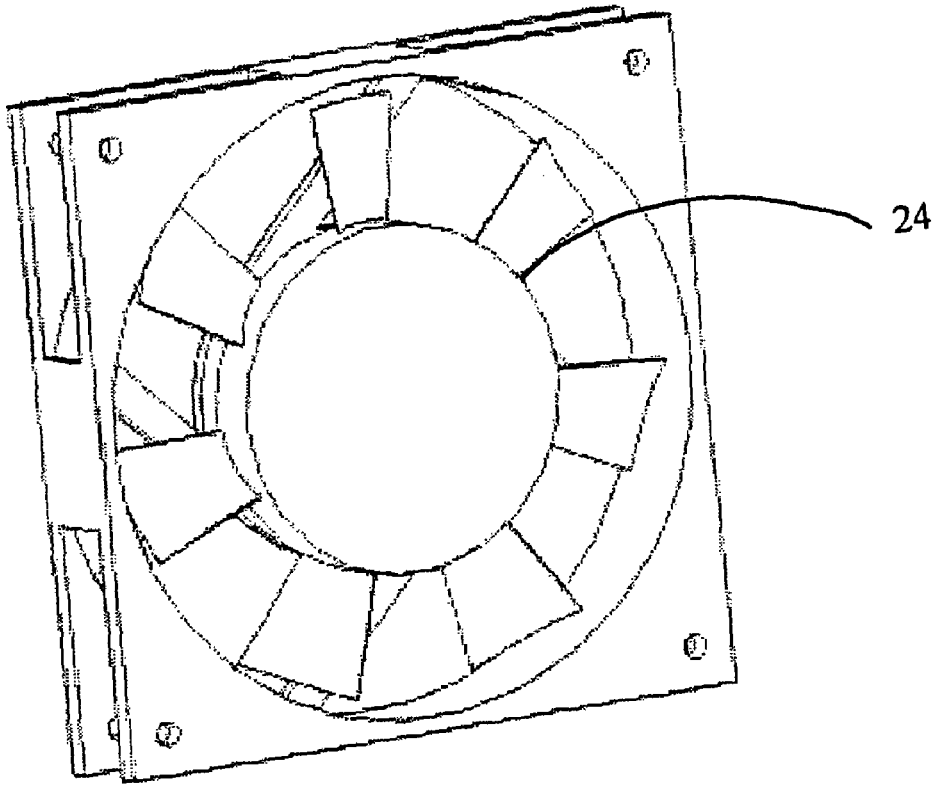
FIG. 29 shows a perspective view of a fan of the present invention.
Figure 30:
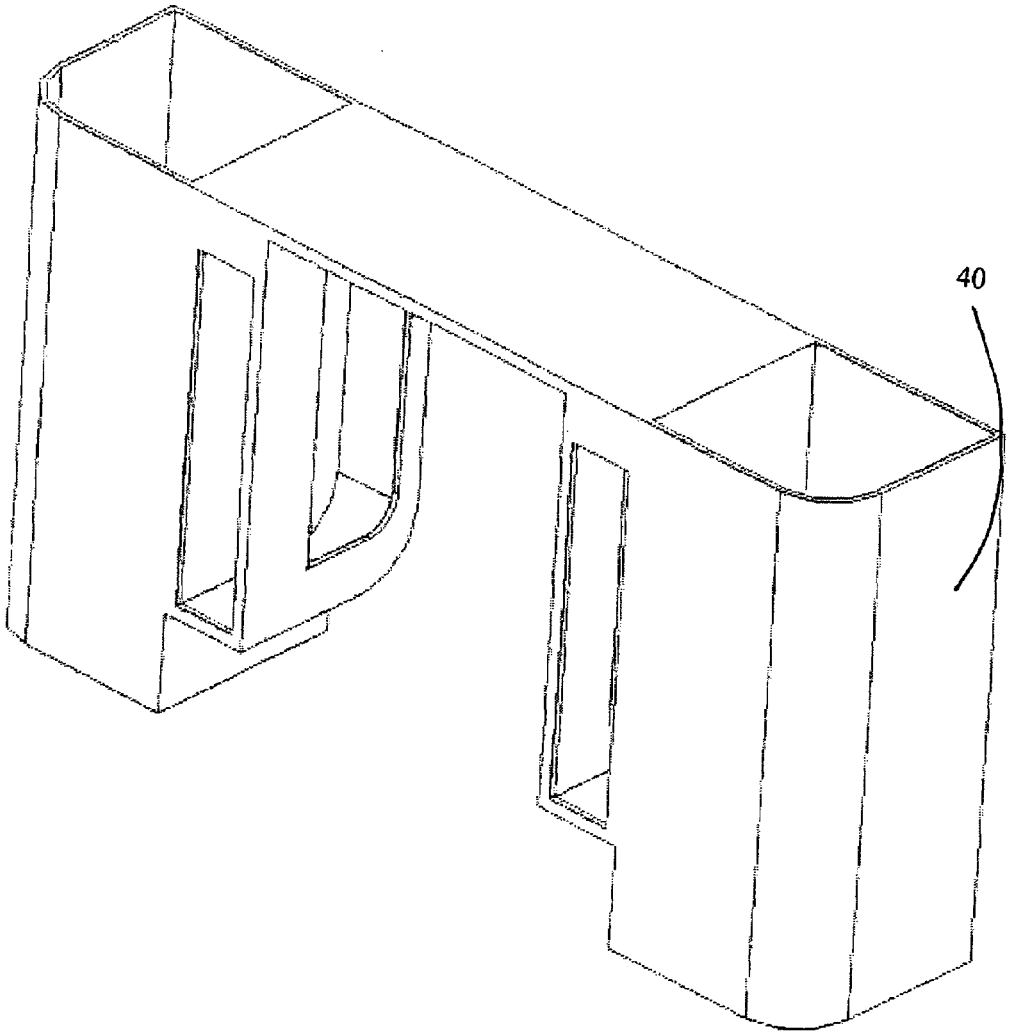
FIG. 30 shows a perspective view of the exterior vent of the present invention.
Figure 31:
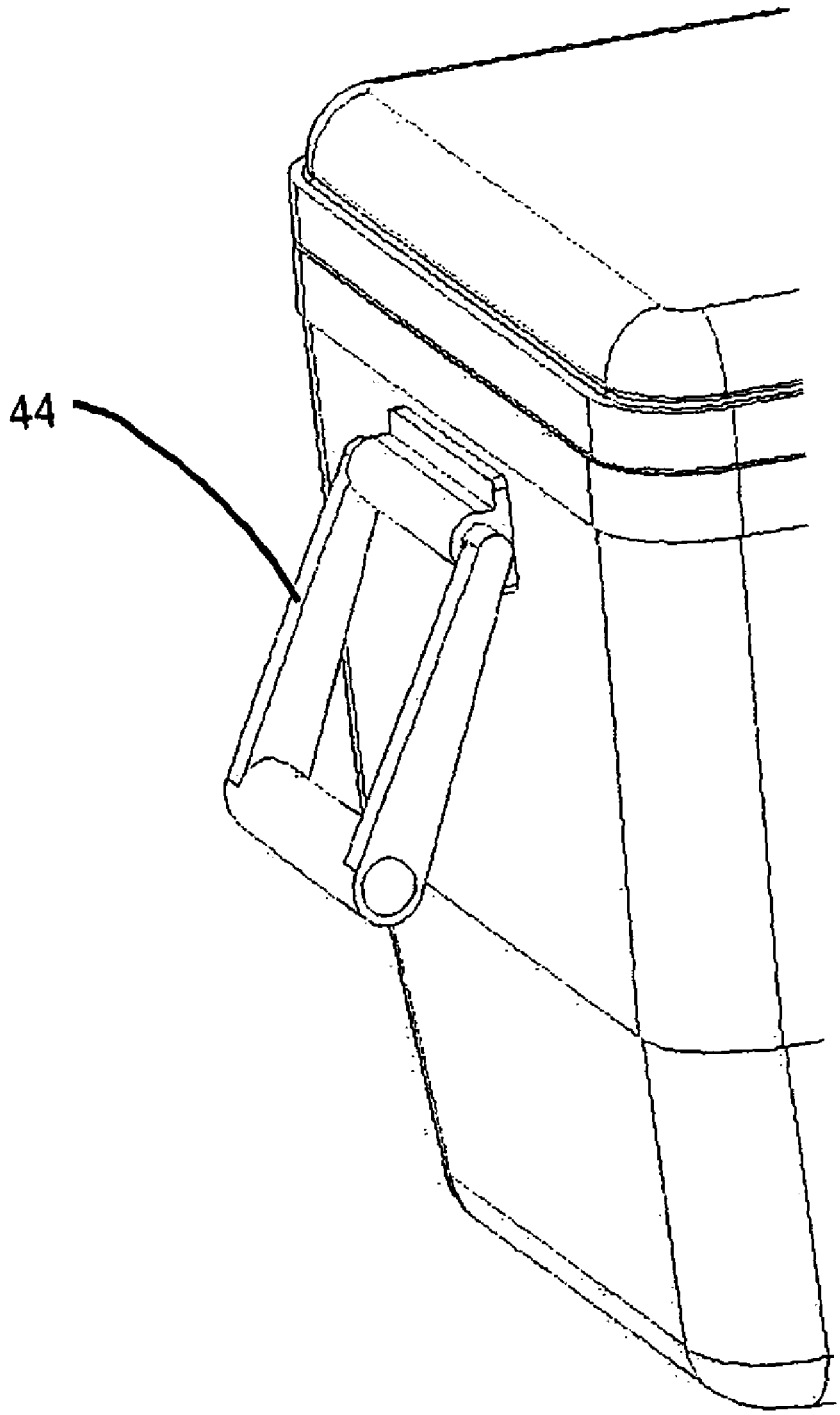
FIG. 31 shows a perspective view of the handle of the container of the present invention.
Figure 32:
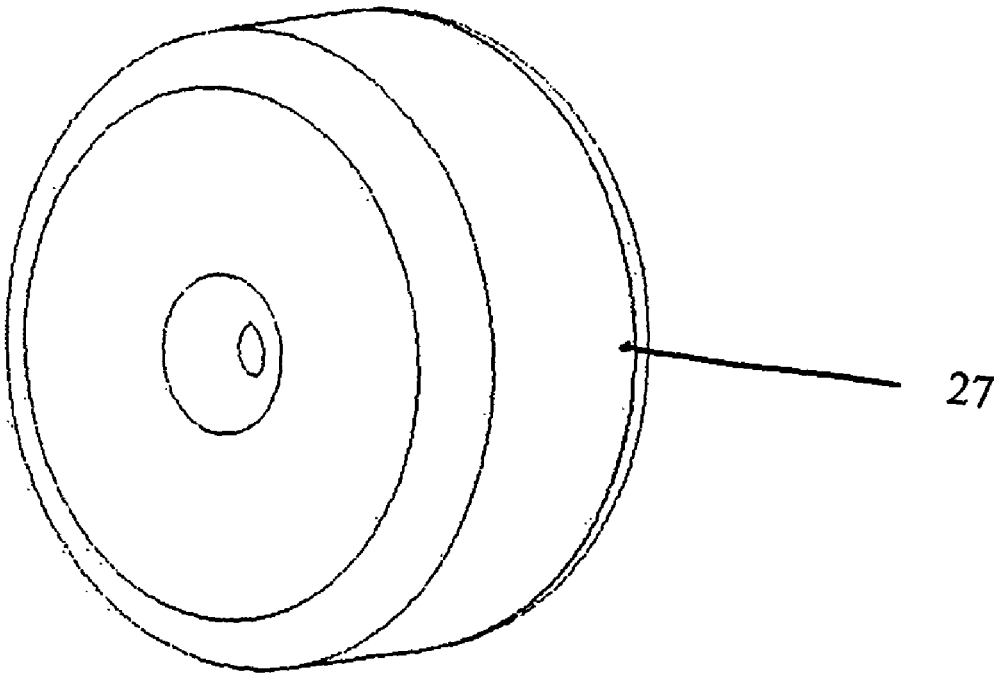
FIG. 32 shows a perspective view of a wheel of the present invention.
Figure 33:
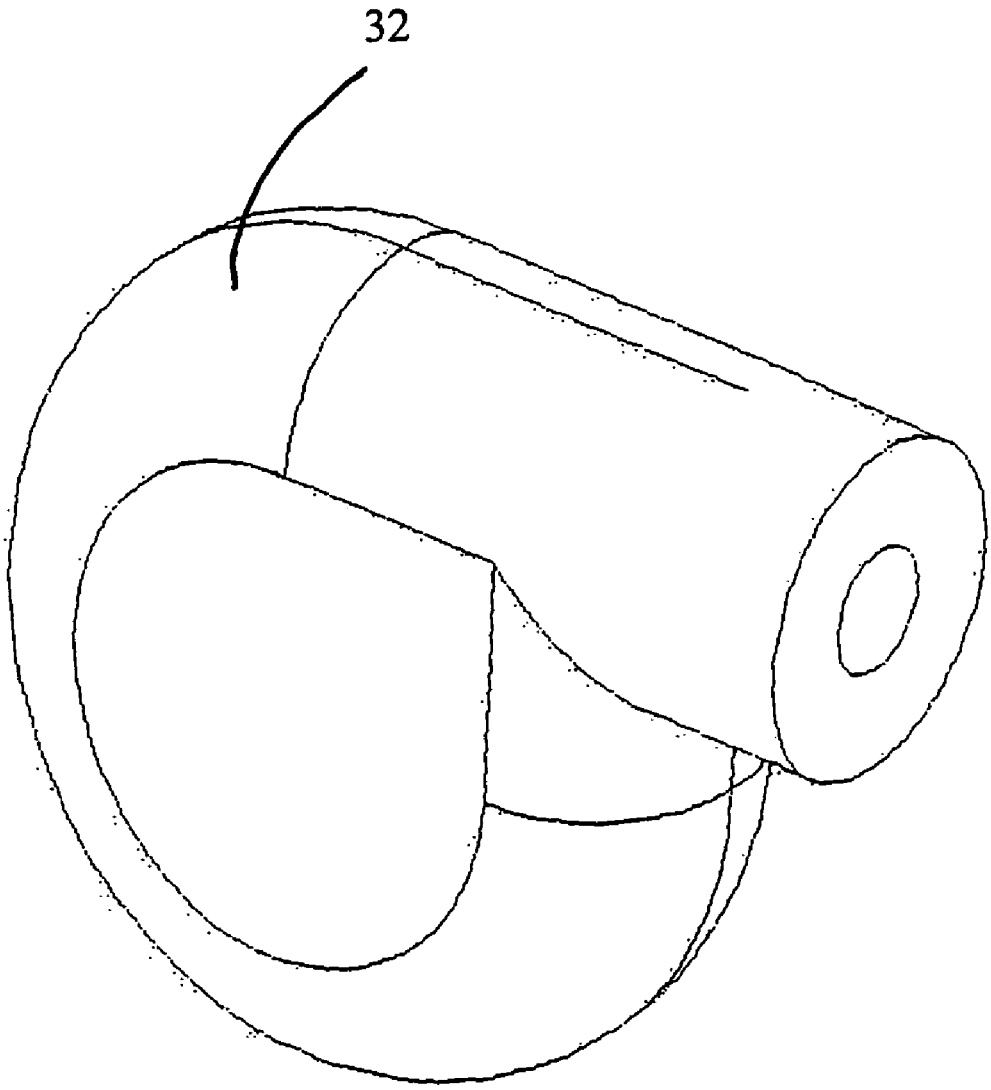
FIG. 33 shows a perspective view of a retractable power cord of the present invention.
Figure 34:
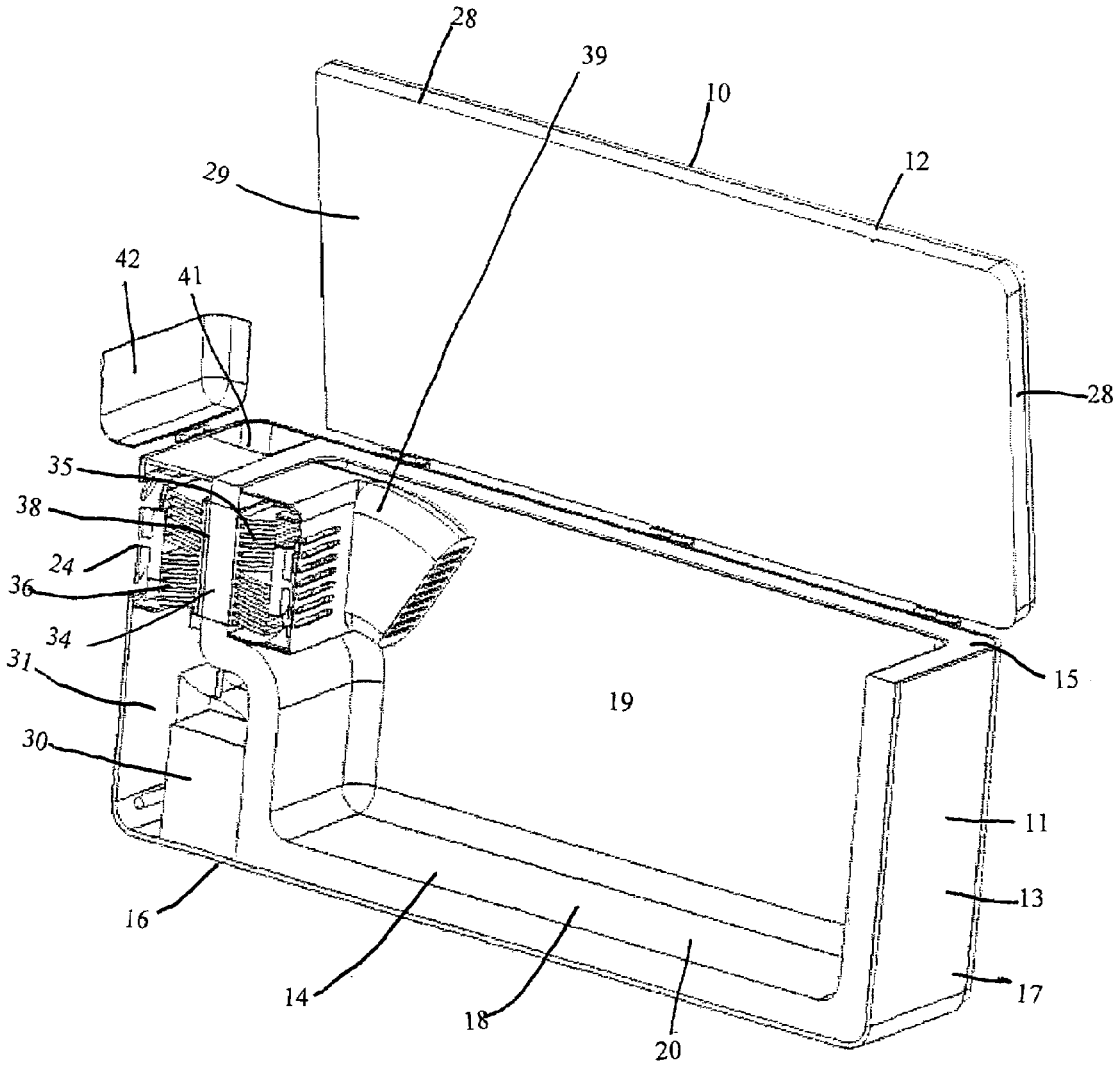
FIG. 34 shows a cutaway view of the preferred embodiment of the present invention with the container lid and the control panel door both in the open position.
Figure 35:
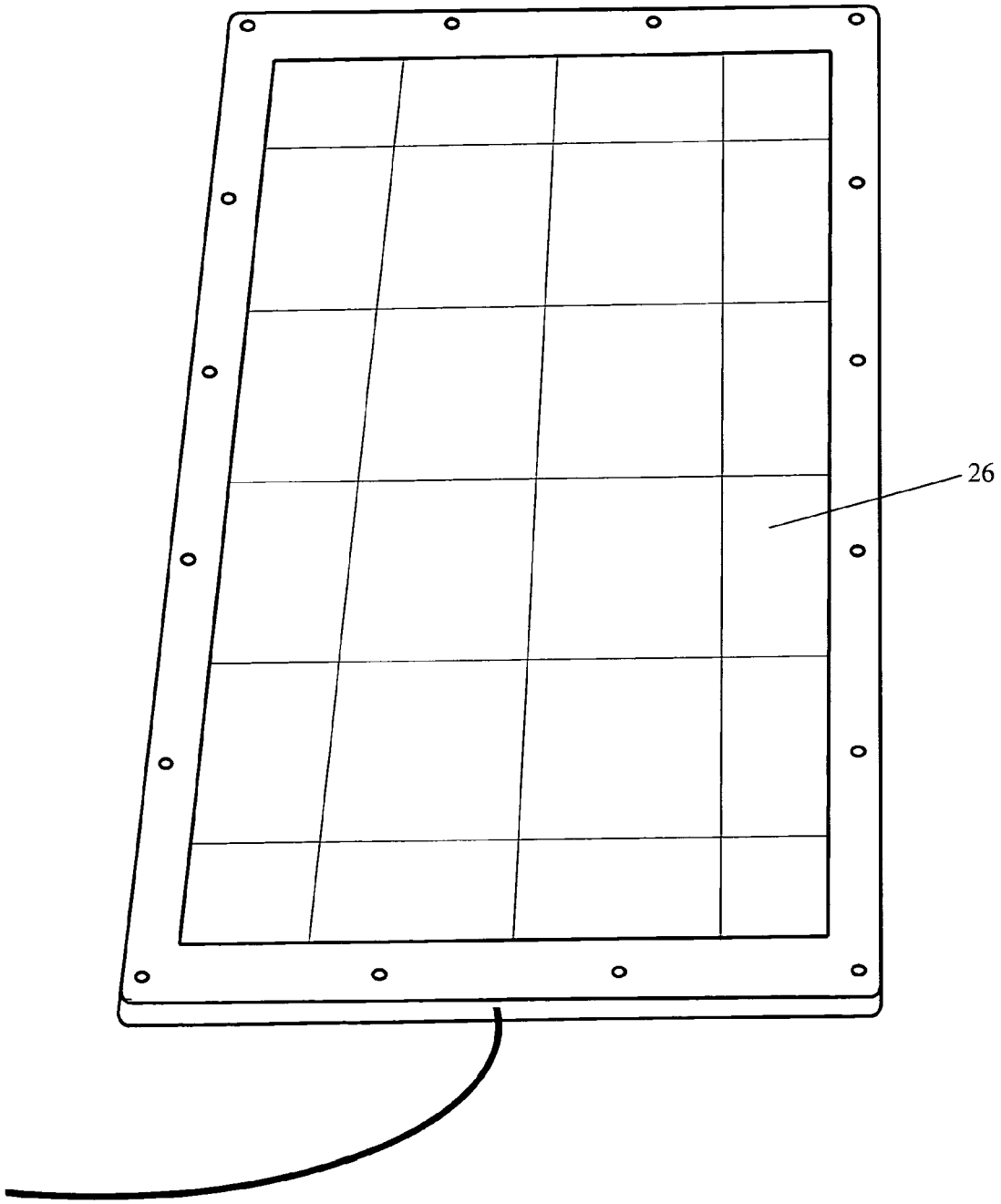
FIG. 35 shows a top view of the solar collector of the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The present invention is a solar-powered refrigeration container 10 for temperature-controlled storage of food, liquids and other temperature-sensitive objects, which can maintain an interior environment preferably about 40° below ambient temperature for the entire duration of adequate sunlight and at least 3 to 4 hours later under battery power. The container is solar-powered with a solar collector on its outer surface, but it also has an internal battery, which powers a thermoelectric cooling unit, fans, control panel and may house other accessories. The battery has an energy save mode, which allows the container to minimize the use of the battery power necessary to keep the container at optimal temperature. The cooler operates using a thermoelectric heating unit, which employs a number of heat sinks, fans and vents to circulate the cool air within the container. On its surface, the container also has a control panel or user interface which allows a user to control the various functionalities of the container.

In general, the present invention is a container 10 of any practicable shape, which comprises a body 11 and a lid 12. The container body 11 includes an outer housing 13 as well as an insulated interior container 14. The housing 13 consists of a top 15 and a bottom surface 16 and at least one sidewall 17. The housing 13 is made of any material sturdy enough to support the products to be refrigerated as well as the various components of the refrigeration system. Examples of such applicable material include but are not limited to most plastics, metals, etc. The material also must be durable in weather conditions such as rain or snow. The top surface 15 of the container 10 will be open so that objects that need cooling may be placed within the container. Within the housing 13 is an interior container 14 which has an interior surface 18 that is made of the same or similar material and is thick and foam-insulated. It consists of at least one interior sidewall 19 as well as an interior bottom surface 20. The interior bottom surface 20 may be flat or may have multiple levels or compartments in which different types of objects can be stored and kept separate from each other. In the preferred embodiment of the present invention, there is an orifice 21 in the sidewall 19 through which the exterior fan 24 used in the refrigeration system resides. There is also a corresponding orifice 22 in the sidewall 17 of the housing 13. In the preferred embodiment, also, attached to the bottom surface 16 of the container 10 is one or more wheels 27 used in conjunction with a handle 44 to transport the container 10 easily from one place to another.

The container 10 of the present invention also contains a lid 12 shaped to match the body 11 of the container. The lid can be attached by any useful means, but, in the preferred embodiment, it is attached to the body 11 of the container 10 by a plurality of hinges, which allow it be freely opened without separation from the container body 11. In other embodiments, the lid 12 may be removable, or may be attached by another mechanism. One example of a possible mechanism would involve the lid 12 sliding off of the top surface 15 of the container 10 along a track on the inner sidewall 19 of the container body 11. Another mechanism would involve the lid 12 being attached to the container body 11 by two protruding tabs that interlocks with two mating orifices in the container body 11 or vice versa and allow the lid 12 to be raised without detaching it form the body 11. This mechanism can also be assisted by a pair of metal or plastic bars that prevent the lid from being opened beyond a certain point.

In the preferred embodiment of the present invention, on the upper surface 25 of the lid 12, there is a solar collector 26, which is of any practicable size. This solar collector 26 is the means for gathering the solar energy that the container 10 needs for its refrigeration system to be functional. Although the solar collector 26 in the preferred embodiment covers the entire lid 12 of the container 10, its size varies based on the size of the environment to be cooled. For example, in alternate embodiments, the solar collector 26 may only cover a portion of the upper surface 25 of the lid 12. It also may be detached from the lid upper surface 25 or may even be placed on another part of the container's outer surface. Furthermore, although in the preferred embodiment, there is one solar collector 26, there may be a plurality of solar collectors in alternate embodiments.

In the preferred embodiment the lid 12 also has a sidewall 28 that extends downward from the lid's upper surface 25 along the entire length of the lid 12. This sidewall 28 fits into place with a recessed portion of the container's top surface 15 when the lid 12 is closed. The lid 12 also has an underside 29 which is generally flat. In the preferred embodiment, on the underside 29 of this lid 12 is a light, which allows a user to view contents of the container 10 when it is opened in a poorly lit area. This light preferably remains off until the lid 12 is lifted, which is when it automatically turns on. There is also preferably a switch whereby the user can turn the light on or off manually. Furthermore, there is a mechanism, such as a dial in an alternate embodiment that allows the user to adjust the brightness of the light. There may also be a motion detector, which turns on the light only when a user reaches his or her hand into the container to retrieve an object. In alternate embodiments, the light may be situated elsewhere on the container. For instance, it may be on the upper surface 25 of the lid 12, to allow the user to see what is on top of the container. The lid 12 is preferably made of the same material as the container body, but may be made of different material, particularly if that material is more useful in maximizing the ability of the solar collector on the lid's upper surface. The lid 12 is also preferably insulated. This is achieved in the preferred embodiment with foam.

As stated above, the solar-powered container 10 of the present invention is not only powered by the solar energy gathered by the solar collector 26, but it also has an internal battery 30 which supplies power to the refrigeration system as well as all other electric components. The battery 30 is continuously recharged by the solar collector 26, meaning it will remain operable outdoors for the entire duration of adequate sunlight. Additionally, when fully charged, the battery 30 will remain operable without solar energy for a period of 3-4 hours in the preferred embodiment. The time limit stated with this feature may be adjusted based on the type of battery and voltage in alternate embodiments. The battery 30 itself is located preferably in a compartment 31 between the bottom surface 16 of the housing 13 and bottom surface 20 of the interior container 14. The compartment 31 is shaped to hold snugly the battery 30 but also to insulate it from any liquids within the interior container or any unfavorable environmental conditions outside the housing. Any type of battery useful to one skilled in the art may be employed, however, in the preferred embodiment, the internal battery is rechargeable. In the preferred embodiment, the battery is a lithium ion battery, useful for its high energy capacity and lack of a "memory effect." However, other disposable (non-rechargeable) or rechargeable batteries, such as lead-acid batteries, lithium ion polymer batteries and nickel-cadmium batteries may be utilized. The batteries may be of a wide variety of voltage capacities as long as they are useful in the art. Although the battery is recharged primarily through the solar energy gathered in the solar collector, in the preferred embodiment, there is a door in the bottom surface or sidewall of the housing from which the battery may be removed in order to recharge it in an outlet or to replace it if it is broken or to clean it off if necessary.

The internal battery 30 also features an energy save mode which allows the cooler to minimize the use of battery power necessary to maintain optimal temperature within the container. The energy save mode preferably operates using a thermostat that calculates both the internal and external temperatures and shuts off or slows down the function of the fans, heat sinks and vents powering the cooling unit when the temperature falls below a certain level. Conversely, when the temperatures exceeds a certain level, the energy save mode would preferably also accelerate the fans, heat sinks and vents. Also, in the preferred embodiment, if the external temperature falls to a certain level, the energy save mode will even shut down the fans, heat sinks and vents until the temperature once again rises above a certain threshold. This would once again allow the battery to recharge while there is adequate sunlight.

Although the container 10 utilizes both a solar collector 26 as well as an internal rechargeable battery 30 that lasts up to 3 to 4 hours, there is another means of powering the refrigeration system. In the preferred embodiment of the present invention, there are two power cords 32, one an AC connector and one a DC connector, that extend from the housing 13 of the container 10. These power cords 32 are both preferably retractable, so as to make for easy storage, and both connectors will recharge the internal battery 30 of the container when they are plugged into an outlet, much like recharging a cell phone or laptop computer. The DC connector will also allow the battery 30 to be recharged by plugging into a car cigarette lighter outlet.

Besides powering the container 10 itself, the various power sources of the present invention may be used to power other electronic equipment. The sidewall 17 of the container 10, in the preferred embodiment, has an outlet panel 33 which can be used to charge or operate most DC accessories, including, but not limited to, radios/stereos, cell phones, laptop computers, portable televisions and even possibly small cooking appliances.

The power provided by the solar collector, internal battery, and AC or DC connectors is used primarily to power the refrigeration system 33 of the present invention. The refrigeration system 33 preferably includes one or more thermoelectric cooling units (TECs) 38, which, along with interior and exterior heat sinks 35 and 36, interior and exterior fans 23 and 24 and interior and exterior vents 39 and 40, circulate the cool air within the container. The TECs 38 each comprise two electrically insulated plates separated by a series of semiconductors, preferably consisting of bismuth telluride. One plate is a "cold junction" or cold site and the other plate is a "hot junction" or hot site. The semi-conductors are of two types, n-type (low energy level) semi-conductors and p-type (high energy level) semi-conductors. The n-type conductors have an excess of electrons and the p-type have a deficiency of electrons. In the preferred embodiment of the present invention the two TECs 38 are separated from the interior heat sink 35 by a spacer block 34. Typically, TECs are powered by DC circuitry. However, here the TECs 38 are directly connected to both the battery power as well as the solar collector 26. Air is absorbed into the interior TEC 38, and as the electrons pass from the low energy level n-type semi-conductors to the high energy level p-type semi-conductors cooling occurs. In this process, heat is absorbed at the cold junction. The electrons then move from a high energy level to a low energy level and heat is released from the interior TEC 38 at the hot junction. The means of expelling the heat at the hot junction site of the interior TEC 38 is through the use of interior heat sink 35. By using more than one TEC, an act known as "cascading," the present invention achieves a greater decrease in the temperature within the container's interior. Thus, the two TECs 38 of the present container 10 are able to maintain an environment 40° below ambient temperature, even in extremely hot climates.

In the preferred embodiment, interior and exterior heat sinks 35 and 36, interior and exterior fans 23 and 24, and interior and exterior vents 39 and 40 assist the TECs 38 in maintaining a refrigerated environment within the interior of the container 14. All of these mechanisms are water proof and fully submersible. This enables use of the container without the risk of liquid shorting out the system. The heat sinks 35 and 36 operate by drawing the hot air into interior and exterior vents 39 and 40. The vents 39 and 40 and fans 23 and 24 also assist in the TECs' 38 circulation of heat out of the container. In an alternate embodiment of the container, an additional means of cooling whatever is in the cooler can be utilized as the cooler has an ice making feature which allows the container to freeze water into ice and release it into the container for the physical cooling of objects into which the ice comes into contact. Also in an alternative embodiment the TEC can be used in reverse to heat an object held within the cooler.

Either on the lid 12 or extending from a sidewall 17 of the container 10 is a control panel/user interface 41, hereinafter called the "control panel," which contains controls and displays relating to the functioning properties of the cooler. The control options allow a user to manipulate one or more of the container's functionalities. The displays, on the other hand, are intended to notify a user of the container's conditions. Essentially any buttons which would be practical to a user can be utilized. However, in the preferred embodiment, there is a temperature adjustment control from where the user may alter the temperature within the cooler. The control panel 41 also contains a display which shows the temperature reading of the environments both inside and outside the cooler. There is also a meter which measures the level of power remaining in the internal battery, as well as notifies the user when the container is operating using the solar collector or when it is using the internal battery power because no adequate sunlight is available. Another display on the control panel of the preferred embodiment is an indicator light which signifies that the lid of the cooler is ajar and, thus, the interior environment is no longer insulated. In another embodiment, the light has a corresponding chime, preferably similar to the sound used by most automobiles which notifies a user that a door is open. A final option that exists in the preferred embodiment is that the user may set a specific temperature that the container must maintain. This would, in turn, set the energy save mode to operate based on the outside environment's deviation from this set temperature. Another option with this control is for the user to be able to set a temperature at which energy save mode will turn on. Examples of other possible control panel features include, but are not limited to, a timer which maybe set to indicate when a particular food or beverage is sufficiently chilled to serve, as well as an on/off switch for the internal battery so that a user may conserve the battery's use in total if so desired and may manually override the energy save system.

In the preferred embodiment a plastic or metal removable door 42 covers the control panel 41 to protect it from unfavorable environmental conditions. Also, preferably on the upper surface 25 of the lid 12 or on the top surface 15 of the container body 11 which is not covered by the lid 12 are a series of utility storage pockets 43 that are ideal for storing sunglasses, keys, a wallet or other accessories.

I claim:

1. A portable refrigeration unit comprising:

a housing having an outer surface formed by a top, a bottom, first and second sides, and a first end and a second end, said top having a first opening therein to form a cavity defined by an interior surface;

a thermally insulating interior body, said body being received within said housing cavity and comprising at least one wall, said at least one wall having a top, a bottom, first and second sides, and a first end and a second end, said body top having an opening therein to form a cavity defined by an interior surface; said body second end being in proximity to said housing second end, and said body first end being displaced from said housing first end to form a compartment therebetween;

a lid, said lid having an outer surface and an inner surface, said lid being pivotally attached to said housing to be pivotable between an open position and a closed position that encloses said body cavity;

a rechargeable battery;

a solar collector received within at least a portion of said lid, said solar collector being configured to be detachable from said lid to permit repositioning of said solar collector, said solar collector being electrically coupled to continuously recharge said battery;

one or more wheels rotatably attached to a lower portion of said housing;

a handle attached to a portion of said housing;

a generator, said generator being coupled to said one or more wheels and being configured to recharge said battery;

one or more thermoelectric cooling units being electrically coupled to said solar collector and to said battery, said one or more thermoelectric cooling units being disposed within a second opening in said body at said first end to be in proximity to said body top surface, said one or more thermoelectric cooling units having a first side facing toward said body cavity and a second side facing away from said body cavity, said one or more thermoelectric cooling units being secured within said second opening to enclose air within said cavity when said lid is in said closed position;

an interior heat sink and an exterior heat sink, said interior heat sink being secured within said body cavity proximate to said first side of said one or more thermoelectric cooling units, and said exterior heat sink being secured to said body to be proximate to said second side of said one or more thermoelectric cooling units;

an interior fan and an exterior fan, said interior fan being secured to said body and positioned to direct air within said body cavity upon said interior heat sink, and said exterior fan being secured to said body and positioned to direct air in proximity to said housing upon said exterior heat sink;

an interior vent, said interior vent comprising one or more walls in said body cavity, said one or more walls comprising one or more intake openings being in proximity to said interior fan, said one or more walls being configured to receive air from said interior heat sink and thereafter be downwardly directed toward a bottom of said interior surface of said body cavity, said one or more walls terminating in one or more outlet openings;

an exterior vent, said exterior vent comprising one or more walls positioned in said compartment between said housing and said body, said one or more walls comprising one or more intake openings being centrally located and in proximity to said exterior fan, said one or more walls of said exterior vent being configured to receive air from said exterior heat sink, with said one or more exterior vent walls thereafter being outwardly directed to terminate in a one or more outlet openings being peripherally located with respect to said one or more inlet openings;

a thermostat configured to measure a current temperature of said body cavity and a temperature at said housing outer surface, said thermostat being configured to slow down or shut off said fans and said one or more thermoelectric cooling units in an energy savings mode when said outer surface temperature reaches a threshold temperature difference with said body cavity temperature;

a control panel comprising a control for setting said threshold temperature difference; and a warning light and/or chime configured to provide notification when said lid is not in said closed position;

a battery power meter configured to indicate remaining battery power and being configured to provide notification when said portable refrigeration unit utilizes battery power due to inadequate sunlight;

wherein said one or more thermoelectric cooling units are configured to transport heat to maintain a desired temperature in said body cavity; said interior and exterior fans, and said interior and exterior heat sinks being configured to increase efficiency of said heat transport relative to said body cavity.

2. The portable refrigeration unit according to claim 1 wherein said solar panel is configured to be placed on a part of said housing, when said solar panel is detached from said lid.

3. The portable refrigeration unit according to claim 1 further comprising one or more of:

a retractable A.C. power cord configured to supply power to said portable refrigeration unit; and a retractable D.C. power cord configured to be plugged into a cigarette lighter outlet to thereby supply power to said portable refrigeration unit.

4. The portable refrigeration unit according to claim 1 wherein said one or more thermoelectric cooling units are configured to transport heat being proximate to said housing outer surface into said body cavity to heat said body cavity.

5. The portable refrigeration unit according to claim 1 wherein said one or more thermoelectric cooling units are configured to transport heat from said body cavity to said housing outer surface to refrigerate said body cavity.

6. The portable refrigeration unit according to claim 1 wherein said one or more thermoelectric cooling units is separated from said interior heat sink by a spacer block.

* * * * *